US006171516B1

(12) United States Patent
Inuzuka et al.

(10) Patent No.: US 6,171,516 B1
(45) Date of Patent: Jan. 9, 2001

(54) TREATMENT AGENT FOR ELASTIC POLYURETHANE FIBERS, AND ELASTIC POLYURETHANE FIBERS TREATED THEREWITH

(75) Inventors: Yoshinobu Inuzuka, Okazaki; Yasushi Miyamoto, Toyohashi; Eiji Kawanishi; Noboru Watanabe, both of Otsu, all of (JP)

(73) Assignees: Takemoto Oil & Fat Co., Ltd.; Du Pont Toray Co., Ltd., both of (JP)

( * ) Notice: Under 35 U.S.C. 154(b), the term of this patent shall be extended for 0 days.

(21) Appl. No.: 09/180,256

(22) PCT Filed: Mar. 10, 1998

(86) PCT No.: PCT/JP98/00989

§ 371 Date: Nov. 6, 1998

§ 102(e) Date: Nov. 6, 1998

(87) PCT Pub. No.: WO98/40553

PCT Pub. Date: Sep. 17, 1998

(30) Foreign Application Priority Data

| | | |
|---|---|---|
| Mar. 13, 1997 | (JP) | 9-078944 |
| Jun. 27, 1997 | (JP) | 9-187445 |
| Jun. 27, 1997 | (JP) | 9-187446 |
| Jun. 27, 1997 | (JP) | 9-187447 |

(51) Int. Cl.[7] ..... D06M 13/184; D06M 15/643

(52) U.S. Cl. ..... 252/8.82; 252/8.84; 8/115.6; 8/DIG. 1

(58) Field of Search ..... 8/115.6, DIG. 1; 252/8.82, 8.84; 428/230, 391

(56) References Cited

FOREIGN PATENT DOCUMENTS

| | | | |
|---|---|---|---|
| 60-081374 | * | 5/1985 | (JP) . |
| 3-146774 | * | 6/1991 | (JP) . |
| 5-5277 | * | 1/1993 | (JP) . |
| 6-200419 | * | 7/1994 | (JP) . |
| 8-269822 | * | 10/1996 | (JP) . |
| 9-188974 | * | 7/1997 | (JP) . |
| 9-217283 | * | 8/1997 | (JP) . |

OTHER PUBLICATIONS

English language translation of JP 8–269,822, Asahi Chemical Industry, pp. 1–21, Oct. 1996.*
English language translation of JP 9–217,283, Asahi Chemical Industry, pp. 1–19, Oct. 1996.*
CAPLUS Abstract of JP 10–053,959, Sanyo Chemical Ind., Feb. 1998.*
CAPLUS Abstract of JP 9–217,227, Asahi Chemical Ind. Co., Aug. 1997.*
CAPLUS Abstract of JP 60–239,519, Asahi Chemical Ind. Co., Nov. 1985.*
CAPLUS Abstract of DD 251,587, VEB Kunstseidenwerk, Nov. 1987.*

* cited by examiner

*Primary Examiner*—Caroline D. Liott
(74) *Attorney, Agent, or Firm*—Austin R. Miller

(57) ABSTRACT

A treatment agent for elastic polyurethane fibers comprising a dispersion in which a higher fatty acid magnesium salt is colloidally dispersed in a silicone mixture consisting of a silicone oil with a viscosity of $5\times10^{-6}$–$50\times10^{-6}$ $m^2/S$ at 25° C. as a dispersion medium and a dispersant mainly comprising a modified silicone at a ratio by weight of the dispersion medium/the dispersant=100/0.5–100/4.5, wherein the amount of the higher fatty acid magnesium salt is 1 to 10 parts by weight per 100 parts by weight of the silicone oil.

18 Claims, 2 Drawing Sheets

TREATMENT AGENT FOR ELASTIC POLYURETHANE FIBERS, AND ELASTIC POLYURETHANE FIBERS TREATED THEREWITH

TECHNICAL FIELD

The present invention relates to a treatment agent for elastic polyurethane fibers, and elastic polyurethane fibers treated by using the treatment agent. In more detail, it relates to a treatment agent for elastic polyurethane fibers, which agent is stable in viscosity for a long time during use in the production process of elastic polyurethane fibers and allows fiber packages having good winding form and reelability to be produced if a treatment agent having a higher fatty acid magnesium salt well dispersed is applied to elastic polyurethane fibers, and which drips less and accumulates less on guides to assure stable operation (fiber passage). The present invention also relates to elastic polyurethane fibers treated by using the treatment agent.

BACKGROUND ARTS

Conventional methods for treating elastic polyurethane yarns include 1) treating by a treatment agent with a higher fatty acid metal salt dispersed in polydimethylsiloxane or mineral oil (JP-B-SHO-37-4586, SHO-40-5557 and HEI-6-15745), 2) treating by a treatment agent with an amino modified silicone added to polydimethylsiloxane or mineral oil (JP-B-SHO-63-8233), 3) treating by a treatment agent with a polyether modified silicone added to polydimethylsiloxane or mineral oil (JP-B-SHO-61-459, and JP-A-HEI-2-127569 and 6-41873), 4) treating by a treatment agent with a silicone resin added to polydimethylsiloxane or mineral oil (JP-B-SHO-42-8438 and 63-12197 and JP-A-HEI-8-74179), 5) treating by a treatment agent with a n amino modified silicone an d a silicone resin added to polydimethylsiloxane or mineral oil (JP-A-HEI-3-294524, 3-51374 and 5-195442), etc.

In the method of treating an elastic polyurethane yarn by a treatment agent with a higher fatty acid metal salt dispersed in polydimethylsiloxane or mineral oil, the initial dispersed state of the higher fatty acid metal salt cannot be retained, which causes cohesion, settlement, etc. with the lapse of time. Since a treatment agent has remarkably low dispersion stability like this, the higher fatty acid metal salt coheres even if the treatment agent is sufficiently stirred when used. So, the elastic polyurethane yarn cannot have satisfactory reelability since the overlying segments of the yarn adhere to each other. Furthermore, since the cohering higher fatty acid metal salt drips and accumulates on guides during processing, it causes yarn breaking disadvantageously. Moreover, if a treatment agent having a large amount of a higher fatty acid metal salt dispersed is used, any matter dissolved from the fibers during processing raises the viscosity of the treatment agent after the lapse of time, and disadvantageously, stable operation cannot be achieved. If a treatment agent with a modified silicone such as an amino modified silicone, polyether modified silicone or silicone resin added to polydimethylsiloxane or mineral oil is used, the effect of preventing the adhesion between yarn segments in an elastic polyurethane resin package is weaker compared to the case of using a treatment with a higher fatty acid metal salt added, and satisfactory reelability cannot be obtained. Especially when a treatment agent containing an amino modified silicone or polyether modified silicone is used for treatment, the inter-fiber friction coefficient becomes very low, and the winding in the package is deformed and no good winding form can be obtained. Furthermore, low molecular components are dissolved out of the fibers, to drip and accumulate as scum on guides with the lapse of time, disadvantageously not allowing stable operation.

DISCLOSURE OF THE INVENTION

An object of the present invention is to provide a treatment agent for elastic polyurethane fibers, which can give excellent winding form and reelability to elastic polyurethane fibers and can decrease the deposition and accumulation of scum on guides during processing, to assure stable operation, and also to provide elastic polyurethane fibers treated by using the treatment agent.

The present invention can provide a treatment agent for elastic polyurethane fibers comprising a dispersion in which a higher fatty acid magnesium salt represented by the following formula I is colloidally dispersed in a silicone mixture consisting of a silicone oil having a viscosity of $5\times10^{31\ 6}$–$50\times10^{31\ 6}$ $m^2/S$ at 25° C. as a dispersion medium and a dispersant with a modified silicone as a main ingredient at a ratio by weight of the dispersion medium/the dispersant=100/0.5–100/4.5, wherein the amount of the higher fatty acid magnesium salt is 1 to 10 parts by weight per 100 parts by weight of the silicone oil.

Formula I

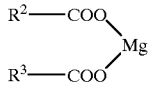

($R^2$, $R^3$: an alkyl group with 11 to 21 carbon atoms)

BRIEF DESCRIPTION OF THE DRAWINGS

The present invention can be understood well in reference to the drawings.

THE BEST EMBODIMENTS OF THE INVENTION

Figure 1:
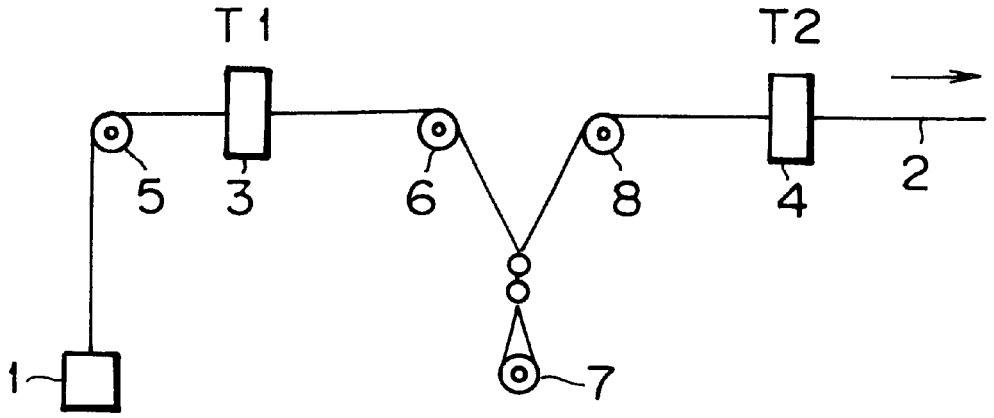
FIG. 1 is a schematic view showing a fiber friction coefficient measuring instrument.

In the treatment agent for elastic polyurethane fibers according to the present invention (hereinafter, simply called "the treatment agent"), the silicone oil used as a dispersion medium has a viscosity of $5\times10^{-6}$–$50\times10^{-6}$ $m^2/S$ at 25° C. A preferable range is $10\times10^{-6}$–$30\times10^{-6}$ $m^2/S$. The viscosity is measured according to the method stated in JIS-K2283 (Petroleum Product Kinematic Viscosity Testing Methods). The siloxane components of such silicone oils include 1) polydimethylsiloxane consisting of dimethylsiloxane component, 2) a polydialkylsiloxane consisting of dimethylsiloxane component and a dialkylsiloxane component containing an alkyl group with 2 to 4 carbon atoms, and 3) a polysiloxane consisting of dimethylsiloxane component and methylphenylsiloxane component. For the silicone oil of the present invention, polydimethylsiloxane is preferable.

In the treatment of the present invention, the modified silicone used as a dispersant is a linear polyorganosiloxane containing dimethylsiloxane component as an essential component.

The modified silicones which can be used here include amino modified silicones, carboxyamide modified silicones, carboxy modified silicones, etc.

In the present invention, an amino modified silicone refers to a linear polyorganosiloxane with dimethylsiloxane component and a siloxane component with an amino modified group, as essential components.

The siloxane component with an amino modified group can be a divalent methyl-amino modified siloxane covered by c existing in the polyorganosiloxane chain or a monovalent dimethyl-amino modified siloxane component or a dimethyl-amino modified silyl component as a terminal group in the following formula II.

The present invention is not limited in the kind or binding position of the amino modified siloxane, but a compound having at least a divalent methyl-amino modified siloxane component covered by c is preferable in view of the dispersibility of the higher fatty acid magnesium salt described hereinafter. When an amino modified group is located in the polyorganosiloxane chain and not at a terminal location, it is preferable that its siloxane component exists simply or is repeated 2 to 5 times. In this case, even if a terminal group is trimethylsiloxane or trimethylsilyl in which $X^1$ or $X^2$ denotes a methyl group, or a dimethyl-amino modified silicone component or dimethyl-amino modified silyl component in which $X^1$ or $X^2$ denotes an amino modified group, inconvenience is not caused.

Formula II

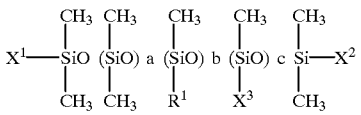

where $X^1$, $X^2$, $X^3$ represent a methyl group or amino modified group represented by $—R^4(NH—R^5)d—NH_2$; at least one of which is an amino $R^1$ represents an alkyl group having 2 to 5 carbon atoms or a phenyl group, R and $R^5$ represent an alkylene group having 2 to 5 carbon atoms, a is an integer of 25 to 400 b is an integer of 0 to 200, subject to the limitation $25 \leqq a \leqq b \leqq 400$, c is an integer of 0 to 10 and d is 0 or 1.

In the amino modified silicone used in the present invention, the siloxane component not containing any amino modified group for forming the polyorganosiloxane main chain can also be a divalent organosiloxane component "b" in the formula II, as well as a dimethylsiloxane component. The repetition numbers of these siloxane components is 25 to 400, but it is especially preferable that dimethylsiloxane component only is used, and that its repetition number is 100 to 200.

In the amino modified silicone, the amino modified group can be an amino alkyl group having 2 to 5 carbon atoms corresponding to the case of d=0 in the general formula $—R^4(NH—R^5—)d-NH_2$, or an aminoalkyl-aminoalkyl group having 2 to 5 carbon atoms in the alkyl group corresponding to the case of d=1. The aminoalkyl group can be, for example, a 2-aminoethyl group, 3-aminopropyl group or 4-aminobutyl group, etc., and among them, 2-aminoethyl group or 3-aminopropyl group can be advantageously used. The aminoalkyl—aminoalkyl group (2) can be, for example, N-(2-aminoethyl)-3-aminopropyl group or N-(2-aminoethyl)-2-aminoethyl group, etc. Among them, the N-(2-aminoethyl)-3-aminopropyl group can be advantageously used.

In the present invention, term "carboxyamide modified silicon" refers to a linear polyorganosiloxane having a dimethylsiloxane component or a cyclohexane component with a carboxyamide modified group, as essential components. The cyclohexane component having a carboxyamide modified group can be a divalent methyl-carboxyamide modified siloxane component covered identified as "d" existing in the polyorganosiloxane chain or a monovalent dimethyl-carboxyamide modified silicone component or dimethyl-carboxyamide modified silyl component as a terminal group in the following formula III. The present invention is not limited in the kind or binding position of the carboxyamide modified siloxane component and/or carboxyamide modified silyl component, but one having at least a divalent methyl-carboxyamide modified siloxane component identified as "d" is preferable because of the dispersibility of the higher fatty acid magnesium salt to be described later. If the carboxyamide modified group exists in the polyorganosiloxane chain and not at a terminal, position it is preferable that the siloxane component containing it exists without being repeated or being repeated 2 to 5 times. In this case, as a terminal group, a trimethylsiloxane component or trimethylsilyl component in which $X^1$ or $X^2$ denotes a methyl group is especially preferable.

Formula III

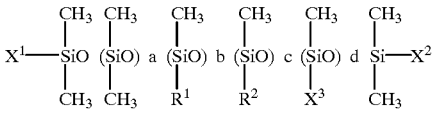

where $X^1$, $X^2$ , $X^3$ represent a methyl group or carboxyamide modified group represented by the following formula IV; and at least one of them is said carboxyamide modified group, $R^1$ represents an alkyl group having 2 to 5 carbon atoms or phenyl group $R^2$ represents $—R^5—(NH—R^6—)f—NH_2$ $R^5$, $R^6$ represents an alkylene group having 2 to 5 carbon atoms, a is an integer of 25 to 400, b is an integer of 0 to 200, c is an integer of 0 to 5, subject to the limitation $25 \leqq a+b+c \leqq 600$ d is an integer of 0 to 10 f is 0 or 1.

$—R^7—(NH—R^8—)e—NHCO—R^9—COOH$ Formula IV where $R^7$, $R^8$ represent an alkylene group having 2 to 5 carbon atoms, $R^9$ represents an alkylene group having 2 to 20 carbon atoms, an alkenylene group with 2 to 20 carbon atoms, alkenylethylene group having a alkenyl group having 2 to 20 carbon atoms or a phenylene group, e is 0 or 1.

In the carboxyamide modified silicone of the present invention, the siloxane component not containing any carboxyamide modified group for forming the polyorganosiloxane main chain can be a divalent organosiloxane component "b" or a divalent amino modified siloxane "c" in the formula III, as well as a dimethylsiloxane component. The sum of the occurrences of these siloxane components in the chain is 25 to 400, but it is especially preferable that the dimethylsiloxane component only is used and that its repetition number in the claim is 100 to 200.

In the carboxyamide modified silicone, the carboxyamide modified group can be a carboxyamidoalkyl group having 2 to 5 carbon atoms in the alkyl group corresponding to the case of (1) e=0 in —$R^7$—(NH—$R^8$—)e—NHCO—$R^9$-COOH represented by the formula IV, or a carboxyamidoalkylaminoalkyl group with 2 to 5 carbon atoms in the alkyl group corresponding to the case of (2) e=1. The carboxyamidoalkyl group (1) can be, for example, N-(2-carboxyethylcarbonyl)-2-aminoethyl group, N-(2-carboxyethylcarbonyl)-3-aminopropyl group or N-(2-carboxyethylcarbonyl)-4-aminobutyl group, etc. Among them, N-(2-carboxyethylcarbonyl)-2-aminoethyl group or N-(2-carboxyethylcarbonyl)-3-aminopropyl group can be advantageously used. The carboxyamidoalkylaminoalkyl group (2) can be, for example, N-[N-(4-carboxybutyllcarbonyl)-2-aminoethyl]-3-aminopropyl group, N-[N-(4-carboxybutylcarbonyl)-2-aminoethyl]-2-aminoethyl group, etc. Among them, N-[N-(4-carboxybutylcarbonyl)-2-aminoethyl]-3-aminopropyl group can be advantageously used.

In the present invention, the carboxy modified silicone refers to a linear polyorganosiloxane containing dimethylsiloxane component and a siloxane component with a carboxy modified group, as essential components. The siloxane component with a carboxy modified group can be a divalent methyl-carboxy modified silicone component covered by g existing in the polyorganosiloxane chain or a monovalent dimethyl-carboxy modified siloxane component or dimethyl-carboxy modified silyl component as a terminal group in the following formula V. The present invention is not limited in the kind or binding position of the carboxy modified siloxane component or carboxy modified silyl component, but a one containing at least a divalent methyl-carboxy modified siloxane component covered by g is preferable in view of the nature to inhibit the rise of viscosity of the treatment with the lapse of time and the dispersibility of the higher fatty acid magnesium salt described later. If a carboxy modified group exists in the polyorganosiloxane chain and not at a terminal, it is preferable that the siloxane component containing it exists without being repeated or is repeated 2 to 20 times. In this case, even if a terminal group is trimethylsiloxane component or trimethylsilyl component in which $X^4$ or $X^5$ denotes a methyl group, or dimethyl-carboxy modified siloxane component or dimethyl-carboxy modified silyl component in which $X^4$ or $X^5$ corresponds to a carboxy modified group in which $X^4$ or $X^5$ denotes a carboxy modified group, no inconvenience is caused.

Formula V

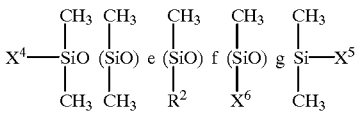

where $X^4$, $X^5$, $X^6$ represent a methyl group or carboxy modified group represented by —$R^7$—COOH; at least one of them is said carboxy modified group, $R^2$ represents an alkyl group with 2 to 5 carbon atoms or phenyl group, $R^7$ represents an alkylene group with 2 to 5 carbon atoms, where e is an integer of 25 to 800, and f is an integer of 0 to 200, subject to 25 e+f800, and g is an integer of 0 to 20)

In the carboxy modified silicone used in the present invention, the siloxane component not containing any carboxy modified group for forming the polyorganosiloxane main chain can be a divalent organosiloxane component covered by f in the formula V, as well as dimethylsiloxane component. The sum of the repetition numbers of these siloxane components is 25 to 800, but it is especially preferable that dimethylsiloxane only is used and that its repetition number is 100 to 400.

In the carboxy modified silicone, the carboxy modified group can be 2-carboxyethyl group, 3-carboxypropyl group or 3-carboxy-1-methylpropyl group, etc. Among them, 3-carboxypropyl group can be advantageously used.

In the present invention, it is also preferable to use an organic carboxylic acid as a dispersant.

The organic carboxylic acids which can be used in the present invention include organic mono- to tetracarboxylic acids with 4 to 22 carbon atoms with a melting point of 50 to 220° C. and their mixtures. They include (1) aliphatic monocarboxylic acids, (2), aliphatic dicarboxylic acids (3) aliphatic dicarboxylic anhydrides, (4) aromatic di- to tetracarboxylic acids and (5) aromatic di- to tetracarboxylic anhydrides. The aliphatic monocarboxylic acids include myristic acid, palmitic acid, stearic acid, arachic acid, behenic acid, etc. The aliphatic dicarboxylic acids and anhydrides include succinic acid, succinic anhydride, maleic acid, maleic anhydride, adipic acid, sebacic acid, azelaic acid, etc. The aromatic di- to tetracarboxylic acids and anhydrides include phthalic anhydride, isophthalic acid, terephthalic acid, trimellitic acid, trimellitic anhydride, pyromellitic acid, pyromellitic anhydride, etc. Among them, aliphatic dicarboxylic acids and aliphatic dicarboxylic anhydrides are preferable, and maleic acid, adipic acid and succinic anhydride are especially preferable.

In the present invention, any or more as a mixture of said organic mono- to tetracarboxylic acids with a melting point of 50 to 220° C. can also be preferably used, and the melting point is measured according to the method stated in JIS-K8004 (General Testing Methods for Reagents). When a mixture of organic mono- to tetracarboxylic acids is used, the rates of the respective organic carboxylic acids to be mixed can be properly decided to have a melting point of 50 to 220° C.

The higher fatty acid magnesium salt represented by the formula I used in the treatment agent of the present invention is any one or more as a mixture of magnesium salts of fatty acids with 12 to 22 carbon atoms. They include (2) magnesium salts of higher fatty acids equal in the number of carbon atoms, (2) magnesium salts of higher fatty acids different in the number of carbon atoms, (3) mixtures of the foregoing. They include, for example, magnesium salt of the same fatty acid such as magnesium dilaurate, magnesium dimyristate, magnesium dipalmitate, magnesium distearate, magnesium diarachate or magnesium dibehenate, magnesium salt of different fatty acids such as magnesium myristate palmitate, magnesium myristate stearate or magnesium palmitate stearate, their mixtures, etc. Among them, magnesium dimyristate, magnesium dipalmitate, magnesium distearate and their mixtures are preferable.

The treatment agent of the present invention is a dispersion in which a higher fatty acid magnesium salt is colloidally dispersed in a silicone mixture consisting of a silicone oil as a dispersion medium and a modified silicone as a dispersant at a predetermined ratio. The ratio by weight of the silicone oil and the modified silicone is silicone oil/modified silicone 100/0.5–100/4.5. A preferable range is 100/0.5–100/2. Furthermore, the amount of the higher fatty acid magnesium salt is 1 to 10 parts by weight per 100 parts by weight of the silicone oil. A preferable range is 2 to 8 parts by weight.

The present invention is not especially limited in the method for dispersing the higher fatty acid magnesium salt into the silicone mixture. For example, the higher fatty acid magnesium salt and the silicone mixture are mixed at a predetermined ratio and wetground to prepare a dispersion in which the higher fatty acid magnesium salt is colloidally dispersed. The grinding machine used for the wet grinding can be a known wet grinder such as a vertical bead mill, horizontal bead mill, sand grinder or colloid mill.

The present invention is not especially limited in the particle size of the colloidal particles in the dispersion with the higher fatty acid magnesium salt colloidally dispersed. However, it is preferable that the average particle size measured according to the method described later is 0.1 to 0.5 $\mu$m.

The dispersion thus obtained in which the higher fatty acid magnesium salt is colloidally dispersed in the silicone mixture is the treatment agent of the present invention.

According to the present invention, the dispersion can further contain the following polyorganosiloxane. The polyorganosiloxane consists of silicic anhydride component represented by the following formula VI and a monovalent organosiloxane component represented by the following formula VII as a silyl terminal group, as main components, and has silanol residues in the molecule.

$[SiO_{4/2}]$ Formula VI $[R^8R^9R^{10}SiO_{1/2}]$ Formula VII where $R^8$, $R^9$, $R^{10}$ represents respectively independently, an alkyl group with 1 to 3 carbon atoms or phenyl group Such a polyorganosiloxane can be produced by known polyorganosiloxane production reactions, i.e., the silanol forming reaction of a silanol formable compound (A) destined for forming the silicic anhydride component represented by said formula VI and a silanol formable compound (B) destined for forming the monovalent organosiloxane component represented by the formula VII, and the polycondensation reaction of the silanol compound produced by the silanol forming reaction.

The polyorganosiloxane used in the present invention contains silanol residues in the molecule as described before. In the polyorganosiloxane production reaction of the present invention, the polyorganosiloxane can be obtained by a siloxane chain growing reaction by the polycodensation reaction of the silanol compound destined for forming the silicic anhydride component and a silyl terminal group forming reaction by the condensation of the silanol groups existing in the siloxane chain and the silanol formable compound (B) destined for forming the monovalent organosiloxane component. In this case, the silanol groups in the siloxane chain which do not participate in the silyl terminal group forming reaction remain as they are in the polyorganosiloxane molecule. In the present invention, the rate of the remaining silanol groups can be adjusted by properly selecting the reaction ratio of the silanol formable compound (A) and the silanol formable compound (B).

In the present invention to achieve a preferable silanol group remaining rate, it is preferable that the molar ratio of the silanol formable compound (A)/the silanol formable compound (B) is $k/[8/5\times(K+1)]-k/[2/5\times(k+1)]$ (where k is an integer of 1 or more). If the ratio of the silanol formable compound (A) and the silanol formable compound (B) is kept in the above range, theoretically 20 to 80 mol % of the silanol groups existing in the polyorganosiloxane chain are blocked by silyl terminal groups in the polyorganolsiloxan e production reaction.

As for the raw materials for forming said siloxane component, the silanol formable compounds which can be used as the compound (A) destined for forming the silicic anhydride component represented by the formula VI include tetraalkoxysilanes such as tetramethoxysilane and tetraethoxysilane, tetrahalogenated silanes such as tetrachlorosilane, etc. The silanol formable compounds which can be used as the compound (B) destined for forming the monovalent siloxane component represented by the formula VII include trialkylalkoxysilanes such as trimethylmethoxysilane, triethylmethoxysilane, tripropylmethoxysilane and dimethylethylmethoxysilane, dialkylphenlalkoxysilanes containing a phenyl group such as dimethylphenylmethoxysilane, trialkylhalogenated silanes such as trimethylchlorosilane, etc.

In the present invention, it is preferable that the polyorganosiloxane content is 0.5 to 5 parts by weight per 100 parts by weight of the silicone oil used as a dispersion medium. An especially preferable range is 1 to 3 parts by weight. The polyorganosiloxane added to the dispersion with the higher fatty acid magnesium colloidally dispersed gives a remarkable effect of preventing the generation of static electricity, to elastic polyurethane fibers without impairing the initial properties.

The treatment agent of the present invention is a dispersion obtained by colloidally dispersing a higher fatty acid magnesium salt into a silicone mixture consisting of a silicone oil as a dispersion medium and an amino modified silicone, carboxyamide modified silicone, amino modified silicone & organic carboxylic acid, or amino modified silicone & carboxy modified silicone as a dispersant. The treatment agent can also be a solution with said polyorganosiloxane dissolved in such a dispersion.

In the colloidal dispersion of the higher fatty acid magnesium salt as the treatment agent of the present invention, the electrification characteristic on the surfaces of the colloidal particles of the higher fatty acid magnesium salt in the dispersion is especially important for inhibiting the cohesion and settlement of the colloidally dispersed higher fatty acid magnesium salt, for retaining stable dispersibility for a long time, and for manifesting desired performance in the production and processing of elastic polyurethane fibers. As the electrification characteristic, the zeta potential measured according to the method described later must be in a range of −30 mV to −100 mV.

The elastic polyurethane fibers to be treated in the present invention mean filaments or fibers made of a long-chain polymer containing at least 85 wt % of a segmented polyurethane.

The polymer contains two types of segments: (a) a long-chain polyester, polyester or polyether ester segment as a soft segment and (b) a relatively short-chain segment derived by the reaction between an isocyanate and a diamine or diol chain extender, as a hard segment. Usually an elastic polyurethane is produced by capping a hydroxyl terminal soft segment precursor by an organic diisocyanate, to obtain a prepolymer, and extending the chain of the prepolymer by a diamine or diol.

Typical polyether segments include those derived from tetramethylene glycol, 3-methyl-1,5-pentanediol, tetrahydrofuran, 3-methyltetrahydrofuran, etc. and their copolymers. Among them, a polyether derived from tetramethylene glycol is preferable. Typical polyester soft segments include reaction products between (a) ethylene glycol, tetramethylene glycol or 2,2-dimethyl-1,3-propanediol, etc. and (b) a dibasic acid such as adipic acid or succinic acid, etc. The soft segment can also be a copolymer like a polyether ester formed from a typical polyether and a typical polyester or from a polycarbonate diol such as poly-(pentane-1,5-carbonate)diol or poly-(hexane-1,6-carbonate) diol, etc.

Typical organic diisocyanates suitable for producing the elastic polyurethane of the present invention include bis-(p-isocyanatophenyl)-methane (MDI), tolylene diisocyanate (TDI), bis-(4-isocyanatocyclohexyl)-methane (PICM), hexamethylene diisocyanate, 3,3,5-trimethyl-5-methylenecyclohexyl diisocyanate, etc. Among them, MDI is especially preferable.

Various diamines such as ethylenediamine, 1,3-cyclohexanediamine and 1,4-cyclohexanediamine are suitable as chain extenders for forming polyurethane urea. A chain terminator can be contained in the reaction mixture to help adjust the final molecular weight of polyurethane urea. Usually the chain terminator is a monofunctional compound with active hydrogen, for example, diethylarine.

The chain extender is not limited to the above amines and can also be a diol. The diols which can be used here include ethylene glycol, 1,3-propanediol, 4-butanediol, neopentyl glycol, 1,2-propylene glycol, 1,4-cyclohexanedimethanol, 1,4-cyclohexanediol, 1,4-bis(—hydroxyethoxy)benzene, bis(—hydroxyethyl)terephthalate, paraxylylenediol, etc. The diol chain extender is not limited to one diol only, and can also be formed by a plurality of diols. It can also be used together with a compound containing one hydroxyl group capable of reacting with an isocyanato group. In this case, the polyurethane can be obtained by, though not limited to, any known method such as melt polymerization or solution polymerization. The polymerization formula is not limited either. For example, the polyurethane can be synthesized by letting a polyol, a diisocyanate and a diol chain extender react with each other simultaneously, or any other method can be used.

The elastic polyurethane fibers can also contain an ultraviolet light absorber based on benzotriazole, weather resisting agent based on hindered amine, antioxidant based on hindered phenol, pigment such as titanium oxide or iron oxide, functional additives such as barium sulfate, zinc oxide, cesium oxide and silver ions.

Solvents suitable for polyurethane solutions include N,N-dimethylacetamide (DMAc), dimethylformamide, dimethyl sulfoxide and N-methylpyrrolidone, and DMAc is the most generally used solvent. A polyurethane concentration of 30 to 40%, especially 35 to 38% (based on the total weight of the solution) is especially suitable for dry spinning into filaments.

Elastic polyurethane fibers obtained by using a diol as the chain extender are usually produced by melt spinning, dry spinning or wet spinning, etc., and elastic polyurethane fibers obtained by using an amine as the chain extender are usually produced by dry spinning. The spinning method in the present invention is not especially limited, but wet spinning using a solvent is desirable.

To make the treatment agent of the present invention deposited on elastic polyurethane fibers, it is necessary to apply the treatment agent as it is without diluting it by a solvent, etc., like neat oiling. The treatment agent can be deposited in any step after spinning before winding as a package, in the step of re-winding the wound package or in the step of warping by a warper, etc. For deposition, a known method such as roller oiling method, guide oiling method or spray oiling method, etc. can be applied. The amount of the treatment agent deposited is 1 to 10 wt % relative to the weight of the elastic polyurethane fibers. A preferable range is 3 to 7 wt %.

Suitable embodiments of the treatment agent of the present invention include the following cases 1) to 32).

1) A treatment agent produced as a dispersion with magnesium distearate (F-1) colloidally dispersed, by adding 5.0 parts by weight of magnesium distearate (F-1) to a silicone mixture consisting of 94.3 parts by weight of a silicone oil (S-1) with a viscosity of $20\times10^{-6}$ $m^2/S$ at 25° C. as a dispersion medium and 0.7 part by weight of an amino modified silicone (A-1) with 180 as a, 0 as b, 1 as c, methyl groups as $X^1$ and $X^2$ and N-(2-aminoethyl)-3-aminopropyl group as $X^3$ in the formula II as a dispersant, mixing the mixture at 20 to 35° C. until it becomes homogeneous, and wet-grinding using a horizontal bead mill.

2) A treatment agent produced as a dispersion with magnesium distearate (F-1) colloidally dispersed, by adding 3.5 parts by weight of magnesium distearate (F-1) to a silicone mixture consisting of 95.3 parts by weight of a silicone oil (S-2) with a viscosity of $10\times10^{-6}$ $m^2/S$ at 25° C. as a dispersion medium and 1.2 parts by weight of an amino modified silicone (A-2) with 110 as 1, 0 as b, 4 as c, methyl groups as $X^1$ and $X^2$ and N-(2-aminoethyl)-3-aminopropyl group as $X^3$ in the formula II, mixing the mixture at 20 to 35° C. until it becomes homogeneous, and wet-grinding using a horizontal bead mill.

3) A treatment agent produced as a dispersion with a mixed higher fatty acid magnesium salt (F-2) of palmitic acid/stearic acid=40/60 (molar ratio) colloidally dispersed, by adding 3.7 parts by weight of a mixed higher fatty acid magnesium salt (F-2) of palmitic acid/stearic acid=40/60 (molar ratio) to a silicone mixture consisting of 95.6 parts by weight of the silicone oil (S-1) as a dispersion medium and 0.7 part by weight of an amino modified silicone (A-3) with 50 as a, 5 as b, 1 as c, methyl groups as $X^1$ and $X^2$, N-(2-aminoethyl)-3-aminopropyl group as $X^3$ and n-propyl group as $R^1$ in the formula II as a dispersant, mixing the mixture at 20 to 3 5° C. until it becomes homogeneous, and wet-grinding using a horizontal bead mill.

4) A treatment agent produced as a dispersion with magnesium stearate (F-1) colloidally dispersed, by adding 5.0 parts by weight of magnesium distearate (F-1) to a silicone mixture consisting of 94. 3 parts by weight of the silicone oil (S-1) as a dispersion medium and 0.7 part by weight of an amino modified silicone (A-4) with 360 as a, 0 as b, 3 as c, methyl groups as $X^1$ and $X^2$ and 3-aminopropyl group as $X^3$ in the formula II as a dispersant, mixing the mixture at 20 to 35° C. until it becomes homogeneous, and wet-grinding using a horizontal bead mill.

5) A treatment agent produced as a dispersion with magnesium distearate (F-1) colloidally dispersed, by adding 3.9 parts by weight of magnesium distearate (F-1) to a silicone mixture consisting of 95.4 parts by weight of the silicone oil (S-1) as a dispersion medium and 0.7 part by weight of an amino modified silicone (A-5) with 180 as a, 50 as b, 1 as c, 3-aminopropyl groups as $X^1$, $X^2$ and $X^3$ and phenyl group as $R^1$ in the formula II as a dispersing agent, mixing the mixture at 20 to 35° C. until it becomes homogeneous, and wet-grinding using a horizontal bead mill.

6) A treatment agent produced as a dispersion with magnesium distearate (F-1) colloidally dispersed, by adding 3.9 parts by weight of magnesium distearate (F-1) to a silicone mixture consisting of 95.4 parts by weight of the silicone oil (S-1) as a dispersion medium and 0.7 part by weight of an amino modified silicone (A-4) with 30 as a, 0 as b, 0 as c, 3-aminopropyl groups as $X^1$ and $X^2$ in the formula II as a dispersant, mixing the mixture at 20 to 35° C. until it becomes homogeneous, wet-grinding using a horizontal bead mill.

7) A treatment agent produced as a dispersion with magnesium distearate (F-1) colloidally dispersed, by adding 3.5 parts by weight of magnesium distearate (F-1) to a silicone mixture consisting of 94.4 parts by weight of the silicone oil (S-1) as a dispersion medium, 1.2 parts by weight of the amino modified silicone (A-1) as a dispersing agent and 0.9 part by weight of an polyorganosiloxane (PS-1) with remaining silanol groups obtained by silanol forming reaction and polycondensation reaction from tetramethylsilane/trimethylmethoxysilane=50/50 (molar ratio), mixing the mixture at 20 to 35° C. until it becomes homogeneous, and wet-grinding using a horizontal bead mill.

8) A treatment agent produced as a dispersion with a mixed higher fatty acid magnesium salt (F-2) of palmitic acid/stearic acid=40/60 (molar ratio) colloidally dispersed, by adding 3.7 parts by weight of a mixed higher fatty acid magnesium salt (F-2) of palmitic acid/stearic acid=40/60 (molar ratio) to a silicone mixture consisting of 93.0 parts by weight of the silicone oil as a dispersion medium, 1.3 parts by weight of the amino modified silicone (A-1) as a dispersant, and 2.0 parts by weight of a polyorganosiloxane (PS-2) with remaining silanol groups obtained by silanol forming reaction and polycodensation reaction from tetramethylsilane/tripropylmethoxysilane=65/35 (molar ratio), mixing the mixture at 20 to 35° C. until it becomes homogeneous, and wet-grinding using a horizontal bead mill.

9) A treatment agent (T-1) produced as a dispersion with magnesium distearate (F-1) colloidally dispersed, by adding 5.0 parts by weight of magnesium distearate (F-1) to a silicone mixture consisting of 94.3 parts by weight of a silicone oil (S-1) with a viscosity of $20\times10^{-6}$ $m^2/S$ at 25° C. as a dispersion medium and 0.7 part by weight of a carboxyamide modified silicone (A-1) with 80 as a, 0 as b and c, methyl groups as $X^1$ and $X^2$ and N-[N-(4-carboxybutylcarbonyl)-2-aminoethyl]-3-aminopropyl group as $X^3$ in the formula III as a dispersant, mixing the mixture at 20 to 35° C. until it becomes homogeneous, and wet-grinding using a horizontal bead mill.

10) A treatment agent (T-2) produced as a dispersion with magnesium distearate (F-1) colloidally dispersed, by adding 3.5 parts by weight of magnesium distearate (F-1) to a silicone mixture consisting of 95.3 parts by weight of a silicone oil (S-2) with a viscosity of $10\times10^{-6}$ $m^2/S$ at 25° C. as a dispersion medium and 1.2 parts by weight of a carboxyamide modified silicone (A-2) with 150 as a, 0 as b, 4 as c, 5 as d, methyl groups as $X^1$ and $X^2$, N-[N-(4-carboxybutylcarbonyl)-2-aminoethyl]-3-aminopropyl group as $X^3$ and N-(2-aminoethyl)-3-aminopropyl group as $R^2$ in the formula III as a dispersant, mixing the mixture at 20 to 35° C. until it becomes homogeneous, and wet-grinding using a horizontal bead mill.

11) A treatment agent (T-3) produced as a dispersion with a mixed higher fatty acid magnesium salt (F-2) of palmitic acid/stearic acid=40/60 (molar ratio) colloidally dispersed, by adding 3.7 parts of a mixed higher fatty acid magnesium salt (F-2) of palmitic acid/stearic acid=40/60 (molar ratio) to a silicone mixture consisting of 95.6 parts by weight of the silicone oil (S-1) as a dispersion medium and 0.7 part by weight of a carboxyamide modified silicone (A-3) with 300 as a, 5 as b, 1 as c, 10 as d, methyl groups as $X^1$ and $X^2$, N-[N-(4-carboxybutylcarbonyl)-2-aminoethyl]-3-aminopropyl group as $X^3$, phenyl group as $R^1$ and N-(2-aminoethyl)-3-aminopropyl group as $R^2$, mixing the mixture until it becomes homogeneous, and wet-grinding using a horizontal bead mill.

12) A treatment agent (T-4) produced as a dispersion with magnesium distearate (F-1) colloidally dispersed, by adding 5.0 parts by weight of magnesium distearate (F-1) to a silicone mixture consisting of 94.3 parts by weight of the silicone oil (S-1) as a dispersion medium and 0.7 part by weight of a carboxyamide modified silicone (A-4) with 570 as a, 0 as b, 3 as c, 15 as d, methyl groups as $X^1$ and $X^2$, N-[N-(4-carboxybutylcarbonyl)-2-aminoethyl]-3-aminopropyl group as $X^3$ and N-(2-aminoethyl)-3-aminopropyl group as $R^2$, mixing the mixture until it becomes homogeneous, and wet-grinding using a horizontal bead mill.

13) A treatment agent (T-4) produced as a dispersion with magnesium distearate (F-1) colloidally dispersed, by adding 3.9 parts by weight of magnesium distearate (F-1) to a silicone mixture consisting of 95.4 parts by weight of the silicone oil (S-1) as a dispersing agent and 0.7 part by weight of a carboxyamide modified silicone (A-5) with 150 as a, 0 as b,c and d and N-(2-carboxyethylcarbonyl)-3-aminopropyl groups as $X^1$ and $X^2$, mixing the mixture until it becomes homogeneous, and wet-grinding using a horizontal bead mill.

14) A treatment agent (T-6) produced as a dispersion with magnesium distearate (F-1) colloidally dispersed, by adding 3.9 parts by weight of magnesium distearate (F-1) to a silicone mixture consisting of 95.4 parts by weight of the silicone oil (S-1) as a dispersion medium and 0.7 part by weight of a carboxyamide modified silicone (A-4) with 160 as a, 0 as b, 1 as c, 9 as d, N-(2-carboxyethylcarbonyl)-3-aminopropyl groups as $X^1$, $X^2$ and $X^3$ and 3-aminopropyl group as $R^2$, mixing the mixture at 20 to 35° C. until it becomes homogeneous, and wet-grinding using a horizontal bead mill.

15) A treatment agent (T-4) produced as a dispersion with magnesium distearate (F-1) colloidally dispersed, by adding 3.5 parts by weight of magnesium distearate (F-1) to a silicone mixture consisting of 94.4 parts by weight of the silicone oil (S-1) as a dispersion medium, 1.2 parts by weight the carboxyamide modified silicone (A-1) as a dispersing agent and 0.9 part by weight of a polyorganosiloxane (PS-1) with remaining silanol groups obtained by silanol forming reaction and polycondensation reaction from tetramethylsilane/trimethylmethoxysilane=50/50 (molar ratio), mixing the mixture at 20 to 35° C. until it becomes homogeneous, and wet-grinding using a horizontal bead mill.

16) A treatment agent (T-8) produced as a dispersion with a mixed higher fatty acid magnesium salt (F-2) of palmitic acid/stearic acid=40/60 (molar ratio), by adding 3.7 parts by weight of a mixed higher fatty acid magnesium salt (F-2) of palmitic acid/stearic acid=40/60 to a silicone mixture consisting of 93.0 parts by weight of the silicone oil (S-2) as a dispersion medium, 1.3 parts by weight of the carboxyamide modified silicone (A-1) as a dispersing agent and 2.0 parts by weight of a polyorganosiloxane (PS-2) obtained by silanol forming reaction and polycondensation reaction from tetramethylsilane/tripropylmethoxysilane=35/65 (molar ratio), mixing the mixture at 20 to 35° C. until it becomes homogeneous, wet-grinding using a horizontal bead mill.

17) A treatment agent (T-1) produced as a dispersion with magnesium distearate (F-1) colloidally dispersed, by adding 5.0 parts of magnesium distearate to a silicone mixture consisting of 94.2 parts by weight of a silicone oil (S-1) with a viscosity of $20\times10^{-6}$ $m^2/S$ at 25° C. as a dispersion medium, 0.7 part by weight of an amino modified silicone (A-1) with 180 as a, 0 as b, 1 as c, methyl groups as $X^1$ and $X^2$ and N-(2-aminoethyl)-3-aminopropyl group as $X^3$ in the formula II as a dispersing agent, and 0.1 part by weight of succinic anhydride, mixing the mixture at 20 to 35° C. until it becomes homogeneous, and wet-grinding using a horizontal bead mill.

18) A treatment agent (T-2) produced as a dispersion with magnesium distearate (F-1) colloidally dispersed, by adding 3.5 parts by weight of magnesium distearate (F-1) to a silicone mixture consisting of 95.2 parts by weight of a silicone oil (S-2) with a viscosity of $10\times10^{-6}$ $m^2/S$ at 25° C. as a dispersion medium, 1.2 parts by weight of an amino modified silicone (A-2) with 110 as a, 0) as b, 4 as c, methyl groups as $X^1$ and $X^2$ and N-(2-aminoethyl)-3-aminopropyl group as $X^3$ in the formula II as a dispersing agent and 0.1 part by weight of succinic anhydride, mixing the mixture at 20 to 35° C. until it becomes homogeneous, and wet-grinding using a horizontal bead mill.

19) A treatment agent (T-3) produced as a dispersion with a mixed higher fatty acid magnesium salt (F-2) of palmitic acid/stearic acid=40/60 (molar ratio) colloidally dispersed, by adding 3.7 parts by weight of a mixed higher fatty acid magnesium salt (F-2) of palmitic acid/stearic acid=40/60 (molar ratio) to a silicone mixture consisting of 95.5 parts by weight of the silicone oil (S-1) as a dispersion medium, 0.7 part by weight of an amino modified silicone (A-3) with 50 as a, 5 as b, 1 as c, methyl groups as $X^1$ and $X^2$, N-(2-aminoethyl)-3-aminopropyl group as $X^3$ and n-propyl group as $R^1$ in the formula II as a dispersant and 0.1 part by weight of succinic anhydride, mixing the mixture at 20 to 35° C. until it becomes homogeneous, and wet-grinding using a horizontal bead mill.

20) A treatment agent (T-4) produced as a dispersion with magnesium distearate (F-1) colloidally dispersed, by adding 5.0 parts of magnesium distearate (F-1) to a silicone mixture consisting of 94.2 parts by weight of the silicone oil (S-1) as a dispersion medium, 0.7 parts by weight of an amino modified silicone (A-4) with 360 as a, 0 as b, 3 as c, methyl groups as $X^1$ and $X^2$ and 3-aminopropyl group as $X^3$ in the formula II as a dispersant and 0.1 part by weight of maleic acid, mixing the mixture at 20 to 35° C. until it becomes homogeneous, and wet-grinding using a horizontal bead mill.

21) A treatment agent (T-5) produced as a dispersion with magnesium distearate (F-1) colloidally dispersed, by adding 3.9 parts by weight of magnesium distearate (F-1) to a silicone mixture consisting of 95.2 parts by weight of the silicone oil (S-1) as a dispersion medium, 0.7 part by weight of an amino modified silicone (A-5) with 180 as a, 50 as b, 1 as c, 3-aminopropyl groups as $X^1$, $X^2$ and $X^3$ and phenyl group as $R^1$ and 0.2 part by weight of adipic acid, mixing the mixture at 20 to 35° C. until it becomes homogeneous, and wet-grinding using a horizontal bead mill.

22) A treatment agent (T-6) produced as a dispersion with magnesium distearate (F-1) colloidally dispersed, by adding 3.9 parts by weight of magnesium distearate (F-1) to a silicone mixture consisting of 94.9 parts by weight of the silicone oil (S-1) as a dispersion medium, 0.7 part by weight of an amino modified silicone (A-6) with 30 as a, 0 as b, 0 as c and 3-aminopropyl groups as $X^1$ and $X^2$ in the formula II as a dispersing agent and 0.5 part by weight of stearic acid, mixing the mixture at 20 to 35° C. until it becomes homogeneous, and wet-grinding using a horizontal bead mill.

23) A treatment agent (T-7) produced as a dispersion with magnesium distearate (F-1) colloidally dispersed, by adding 4.0 parts by weight of magnesium distearate (F-1) to a silicone mixture consisting of 94.2 parts by weight of the silicone oil (S-1) as a dispersion medium, 0.7 part by weight of the amino modified silicone (A-1) as a dispersing agent, 0.1 part by weight of succinic anhydride and 1.0 part by weight of a polyorganosiloxane (PS-1) with remaining silanol groups obtained by silanol forming reaction and polycondensation reaction from tetramethylsilane/trimethylmethoxysilane=50/50 (molar ratio), mixing the mixture at 20 to 35° C. until it becomes homogeneous, and wet-grinding using a horizontal bead mill.

24) A treatment agent (T-8) with a mixed higher fatty acid magnesium salt (F-2) of palmitic acid/stearic acid=40/60 (molar ratio) colloidally dispersed, by adding 2.0 parts by weight of a mixed higher fatty acid magnesium salt (F-2) of palmitic acid/stearic acid=40/60 (molar ratio) to a silicone mixture consisting of 92.5 parts by weight of the silicone oil (S-2) as a dispersion medium, 1.2 parts by weight of the amino modified silicone (A-1) as a dispersing agent, 0.1 part by weight of succinic anhydride and 1.5 parts by weight of a polyorganosiloxane (PS-2) with remaining silanol groups obtained by silanol forming reaction and polycondensation reaction from tetramethylsilane/tripropylmethoxysilane=35/65 (molar ratio), mixing the mixture at 20 to 35° C. until it becomes homogeneous, and wet-grinding using a horizontal bead mill.

25) A treatment agent (T-1) with magnesium distearate (F-1) colloidally dispersed, by adding 5.0 parts by weight of magnesium distearate (F-1) to a silicone mixture consisting of 94.2 parts by weight of a silicone oil (S-1) with a viscosity of $20\times10^{-6}$ $m^2/S$ at 25° C. as a dispersion medium, 0.7 part by weight of an amino modified silicone (A-1) with 180 as a, 0 as b, 1 as c, methyl groups as $X^1$ and $X^2$ and N-(2-aminoethyl)-3-aminopropyl group as $X^3$ in the formula II as a dispersant and 0.1 part by weight of a carboxy modified silicone (B-1) with 30 as e, 0 as f, 2 as g, methyl groups as $X^4$ and Xi and 3-carboxypropyl group as $X^6$ in the formula V, mixing the mixture at 20 to 35° C. until it becomes homogeneous, and wet-grinding using a horizontal bead mill.

26) A treatment agent (T-2) produced as a dispersion with magnesium distearate (F-1) colloidally dispersed, by adding 3.5 parts of magnesium distearate (F-1) to a silicone mixture consisting of 95.2 parts by weight of a silicone oil (S-2) with a viscosity of $10\times10^{-6}$ $m^2/S$ at 25° C. as a dispersion medium, 1.2 parts by weight of an amino modified silicone (A-2) with 110 as a, 0 as b, 4 as c, methyl groups as $X^1$ and $X^2$ and N-(2-aminoethyl)-3-aminopropyl group as $X^3$ in the formula II as a dispersant and 0.1 part by weight of a carboxy modified silicone (B-2) with 300 as e, 0 as f, 9 as g, methyl groups as $X^4$ and $X^5$ and 3-carboxypropyl group as $X^6$ in the formula V, mixing the mixture at 20 to 35° C. until it becomes homogeneous, and wet-grinding using a horizontal bead mill.

27) A treatment agent (T-3) produced as a dispersion with a mixed higher fatty acid magnesium salt (F-2) of palmitic acid/stearic acid=40/60 (molar ratio) colloidally dispersed, by adding 3.7 parts by weight of a mixed higher fatty acid magnesium salt (F-2) of palmitic acid/stearic acid=40/60 (molar ratio) to a silicone mixture consisting of 95.6 parts by weight of the silicone oil (S-1) as a dispersion medium, 0.7 part by weight of an amino modified silicone (A-3) with 50 as a, 5 as b, 1 as c, methyl groups as $X^1$ and $X^2$, N-(2-aminoethyl)-3-aminopropyl group as $X^3$ and n-propyl group as $R^1$ in the formula II as a dispersant and 0.1 part by weight of a carboxy modified silicone (B-3) with 400 as e, 350 as f, 18 as g, methyl groups as $X^4$ and $X^5$, 3-carboxypropyl group as $X^6$ and n-propyl group as $R^2$ in the formula V, mixing the mixture at 20 to 35° C. until it becomes homogeneous, and wet-grinding using a horizontal bead mill.

28) A treatment agent (T-4) produced as a dispersion with magnesium distearate (F-1) colloidally dispersed, by adding 5.0 parts by weight of magnesium distearate (F-1) to a silicone mixture consisting of 94.2 parts by weight of the silicone oil (S-1) as a dispersion medium, 0.7 part by weight of an amino modified silicone (A-4) with 360 as a, 0 as b, 3 as c, methyl groups as $X^1$ and $X^2$ and 3-aminopropyl group as $X^3$ in the formula II as a dispersant, 0.1 part by weight of a carboxy modified silicone (B-4) with 50 as e, 0 as f, 5 as g, methyl groups as $X^4$ and $X^5$ and 3-carboxypropyl group as $X^6$ in the formula V, mixing the mixture at 20 to 35° C. until it becomes homogeneous, and wet-grinding using a horizontal bead mill.

29) A treatment agent (T-5) produced as a dispersion with magnesium distearate (F-1) colloidally dispersed, by adding 3.9 parts by weight of magnesium distearate (F-1) to a silicone mixture consisting of 95.2 parts by weight of the silicone oil (S-1) as a dispersion medium, 0.7 part by weight of an amino modified silicone (A-5) with 180 as a, 50 as b, 2 as c, 3-aminopropyl groups as $X^1$, $X^2$ and $X^3$ and phenyl group as $R^1$ in the formula II as a dispersing agent, and 0.2 part by weight of a carboxy modified silicone (B-5) with 200 as e, 10 as f,0 as g, 3-carboxypropyl groups as X4 and $X^5$ and phenyl group as $R^2$ in the formula V, mixing the mixture at 20 to 35° C. until it becomes homogeneous, and wet-grinding using a horizontal bead mill.

30) A treatment agent (T-6) produced as a dispersion with magnesium distearate (F-1) colloidally dispersed, by adding 3.9 parts by weight of magnesium distearate (F-1) to a silicone mixture consisting of 94.7 parts by weight of the silicone oil (S-1) as a dispersion medium, 0.7 part by weight of an amino modified silicone (A-6) with 30 as a, 0 as b, 0 as c, 3-aminopropyl groups as $X^1$ and $X^2$ in the formula II as a dispersant and 0.7 part by weight of a carboxy modified silicone (B-6) with 200 as e, 0 as f, 2 as g and 3-carboxypropyl groups as $X^4$, $X^5$ and $X^6$ in the formula V, mixing the mixture at 20 to 35° C. until it becomes homogeneous, and wet-grinding using a horizontal bead mill.

31) A treatment agent (T-7) produced as a dispersion with magnesium distearate (F-1) colloidally dispersed, by adding 3.5 parts by weight of magnesium distearate (F-1) to a silicone mixture consisting of 94.36 parts by weight of the silicone oil (S-1) as a dispersion medium, 1.2 parts by weight of the amino modified silicone (A-1) as a dispersing agent and 0.9 part by weight of a polyorganosiloxane (PS-1) with remaining silanol groups obtained by silanol forming reaction and polycondensation reaction from tetramethylsilane/trimethylmethoxysilane=50/50 (molar ratio), mixing the mixture at 20 to 35° C. until it becomes homogeneous, and wet-grinding using a horizontal bead mill.

32) A treatment agent (T-8) produced as a dispersion with a mixed higher fatty acid magnesium salt (F-2) of palmitic acid/stearic acid=40/60 (molar ratio) colloidally dispersed, by adding 3.7 parts by weight of a mixed higher fatty acid magnesium salt (F-2) of palmitic acid/stearic acid=40/60 (molar ratio) to a silicone mixture consisting of 92.5 parts by weight of the silicone oil (S-2) as a dispersion medium, 1.3 parts by weight of the amino modified silicone (A-1) as a dispersant and 2. parts by weight of a polyorganosiloxane (PS-2) with remaining silanol groups obtained by silanol forming reaction and polycodensation reaction from tetramethylsilane/tripropylmethoxysilane=35/65 (molar ratio), mixing the mixture at 20 to 35° C. until it becomes homogeneous, and wet-grinding using a horizontal bead mill.

Suitable embodiments of the elastic polyurethane fibers treated by the treatment agent according to the present invention include the following cases 33) to 44).

33) 2000 g of polytetramethylene glycol with a molecular weight of 2000 and 400 g of bis-(p-isocyanatophenyl)-methane (MDI) were supplied into a nitrogen-sealed stirring reactor to achieve an addition ratio of 1.60, and caused to react with each other at 90° C. for 3 hours, to obtain a capped glycol. Then, 699 g of the capped glycol was dissolved into 1093 g of N,N-dimethylacetamide (DMAC), and furthermore at room temperature, a mixture consisting of 11 g of ethylenediamine as a chain extender, 1.6 g of diethylamine as a chain terminator and 195 of DMAC was added in a high speed stirring machine, for chain extension, to obtain a polymer solution with a solid content of 35.6 wt %.

Titanium oxide, a hindered amine based weather resisting agent and a hindered phenol based antioxidant were added to the polymer solution, to achieve contents of 4.7 wt %, 3.0 wt % and 1.2 wt % respectively, and the mixture was mixed to obtain a homogeneous polymer mixture.

The polymer mixture obtained was spun into a 40-denier elastic yarn consisting of four fibers by a known dry spinning method used for spandex, and the treatment agent of said 1) was neat-oiled by an oiling roller before winding, to obtain elastic polyurethane fibers with said treatment deposited by 6.5 wt % based on the weight of the elastic polyurethane fibers.

34) The treatment agent of said 2) was neat-oiled to a 40-denier elastic yarn consisting of four fibers obtained as described in said 33), according to the same method as described in the above-described 33), to obtain elastic polyurethane fibers with the treatment deposited by 3.5 wt % based on the weight of the elastic polyurethane fibers.

35) The treatment agent of any of said 3) to 8) was neat-oiled to a 40-denier elastic yarn consisting of four fibers obtained as described in the above-described 33), according to the same method as described in the above-described 33), to obtain elastic polyurethane fibers with the treatment deposited by 5 wt % based on the weight of the elastic polyurethane fibers, respectively.

36) A mixture of bis-(p-isocyanatophenyl)-methane/tetramethylene ether glycol (number average molecular weight 1800)1.58/1 (molar ratio) was caused to react at 90° C. for 3 hours according to a conventional method, to prepare a capped glycol. The capped glycol was diluted by N,N-dimethylacetamide (DMAc). Then, a DMAc solution containing ethylenediamine and diethylamine was added to the capped glycol DMAc solution, and the mixture was mixed at room temperature using a high speed stirring machine, for chain extension. Furthermore, DMAc was added, to obtain a DMAc solution with an about 35 wt % of a polymer dissolved. Titanium oxide, a hindered amine based weather resisting agent and a hindered phenol based antioxidant were added to the obtained polymer DMAC solution, to achieve 4.7 wt %, 3.0 wt % and 1.2 wt % respectively based on the weight of the polymer, and the mixture was mixed to obtain a homogeneous polymer mixture. The obtained polymer mixture was spun into a 40-denier elastic yarn consisting of four fibers by a conventional dry spinning method for spandex, and the treatment of said 9) was neat-oiled by an oiling roller before winding, to obtain elastic polyurethane fibers with the treatment deposited by 6.5 wt % based on the weight of the elastic polyurethane fibers.

37) The treatment agent of said 10) was neat-oiled to a 40-denier elastic yarn consisting of four fibers obtained as described in said 36), according to the same method as described in said 36), to obtain elastic polyurethane fibers with the treatment deposited by 3.5 wt % based on the weight of the elastic polyurethane fibers.

38) The treatment agent of any of said 11) to 16) was neat-oiled to a 40-denier elastic yarn consisting of four fibers obtained as described in said 36), according to the same method as described in said 36), to obtain elastic polyurethane fibers with the treatment deposited by 5 wt % based on the weight of the elastic polyurethane fibers, respectively.

39) The treatment agent of said 17) was neat-oiled to a 40-denier elastic yarn consisting of four fibers obtained as described in said 36), according to the same method as described in said 36), to obtain elastic polyurethane fibers with the treatment deposited by 6.5 wt % based on the weight of the elastic polyurethane fibers.

40) The treatment agent of said 18) was neat-oiled to a 40-denier elastic yarn consisting of four fibers obtained as described in said 36), according to the same method as described in said 36), to obtain elastic polyurethane fibers with the treatment deposited by 3.5 wt % based on the weight of the elastic polyurethane fibers.

41) The treatment agent of any of said 19 to 24) was neat-oiled to a 40-denier elastic yarn consisting of four fibers obtained as described in said 36), according to the same method as described in said 36), to obtain elastic polyurethane fibers with the treatment deposited by 5.0 wt % based on the weight of the elastic polyurethane fibers, respectively.

42) The treatment agent of said 25) was neat-oiled to a 40-denier elastic yarn consisting of four fibers obtained as described in said 36), according to the same method as described in said 36), to obtain elastic polyurethane fibers with the treatment deposited by 6.5 wt % based on the weight of the elastic polyurethane fibers.

43) The treatment agent of said 26) was neat-oiled to a 40-denier elastic yarn consisting of four fibers obtained as described in said 36), according to the same method as described in said 36), to obtain elastic polyurethane fibers with the treatment deposited by 3.5 wt % based on the weight of the elastic polyurethane fibers.

44) The treatment agent of any one of said 27) to 32) was neat-oiled to a 40-denier elastic yarn consisting of four fibers obtained as described in said 36), according to the same method as described in said 36), to obtain elastic polyurethane fibers with the treatment deposited by 5.0 wt % based on the weight of the elastic polyurethane fibers, respectively.

EXAMPLES

To show the constitution and effects of the present invention more concretely, examples are described below. However, the present invention is not limited thereto. In the following examples, "parts" means "parts by weight" and "%" means "wt %" unless otherwise stated.

Example 1

Test class 1 (Preparation of Treatment Agents)

Preparation of treatment agent T-1

5.0 parts of magnesium stearate (F-1) were added to a silicone mixture consisting of 94.3 parts of a silicone oil (S-1) with a viscosity of $20\times10^{-6}$ $m^2/S$ at 25° C. as a dispersion medium and 0.7 part of the amino modified silicone (A-1) shown in Table 1, and the mixture was mixed at 20 to 35° C. until it became homogeneous, and wet-ground using a horizontal bead mill, to prepare a dispersion with magnesium distearate (F-1) colloidally dispersed, as treatment agent T-1.

Preparation of treatment agents T-2 to T-6 and t-1 to t-8

Treatment agents T-2 to T-6 and t-1 to t-8 were prepared as described for preparing the treatment agent T-1. The details of these treatment agents are shown in Tables 2 and 3.

Preparation of treatment agent T-7

3.5 parts of magnesium distearate (F-1) were added to a silicone mixture consisting of 94.4 parts of the silicone oil (S-1) as a dispersion medium, 1.2 parts of the amino modified silicone (A-1) as a dispersant and 0.9 part of the polyorganosiloxane (PS-1) shown below Table 2, and the mixture was mixed at 20 to 35° C. until it became homogeneous, and wet-ground using a horizontal bead mill, to prepare treatment agent T-7 with magnesium distearate (F-1) colloidally dispersed.

Preparation of treatment agent T-8

Treatment agent T-8 was prepared as described for preparing the treatment agent T-7. The details are shown in Table 2.

Preparation of treatment agent t-9

1.5 parts of magnesium distearate (F-1) were added to 98.5 parts of the silicone oil (S-1) used as a dispersion medium, and the mixture was mixed at 20 to 35° C. until it became homogeneous and wet-ground using a horizontal bead mill, to prepare treatment agent t-9 with magnesium distearate (F-1) colloidally dispersed.

TABLE 1

| | Amino modified silicone | | | | | | |
|---|---|---|---|---|---|---|---|
| Symbol | a | b | c | $X^1$ | $X^2$ | $X^3$ | $R^1$ |
| A-1 | 180 | 0 | 1 | Methyl group | Methyl group | AM-1 | — |
| A-2 | 110 | 0 | 4 | Methyl group | Methyl group | AM-1 | — |
| A-3 | 50 | 5 | 1 | Methyl group | Methyl group | AM-1 | n-propyl group |
| A-4 | 360 | 0 | 3 | Methyl group | Methyl group | AM-2 | — |
| A-5 | 180 | 50 | 0 | AM-2 | AM-2 | — | Phenyl group |
| A-6 | 30 | 0 | 0 | AM-2 | AM-2 | — | — |
| a-1 | 20 | 0 | 1 | Methyl group | Methyl group | AM-1 | — |
| a-2 | 500 | 0 | 3 | Methyl group | Methyl group | AM-1 | — |
| a-3 | 100 | 0 | 20 | Methyl group | Methyl group | AM-1 | — |

In Table 1,

AM-1: $—C_3H_6—NH—C_2H_4—NH_2$

AM-2: $—C_3H_6—NH_2$

TABLE 2

| | Silicone oil (S) | | Amino modified silicone (A) | | Higher fatty acid magnesium salt (F) | | Polyorganos iloxane (PS) | | | | |
|---|---|---|---|---|---|---|---|---|---|---|---|
| Treatment | Kind | Amount | Kind | Amount | Kind | Amount | Kind | Amount | S/A | S/F | S/PS |
| T-1 | S-1 | 94.3 | A-1 | 0.7 | F-1 | 5.0 | — | — | 100/0.7 | 5.3 | 0 |
| T-2 | S-2 | 95.3 | A-2 | 1.2 | F-1 | 3.5 | — | — | 100/1.3 | 3.7 | 0 |
| T-3 | S-1 | 95.6 | A-3 | 0.7 | F-2 | 3.7 | — | — | 100/0.7 | 3.9 | 0 |
| T-4 | S-1 | 94.3 | A-4 | 0.7 | F-1 | 5.0 | — | — | 100/0.7 | 5.3 | 0 |
| T-5 | S-1 | 95.4 | A-5 | 0.7 | F-1 | 3.9 | — | — | 100/0.7 | 4.1 | 0 |
| T-6 | S-1 | 95.4 | A-6 | 0.7 | F-1 | 3.9 | — | — | 100/0.7 | 4.1 | 0 |
| T-7 | S-1 | 94.4 | A-1 | 1.2 | F-1 | 3.5 | PS-1 | 0.9 | 100/1.3 | 3.7 | 1.0 |
| T-8 | S-2 | 93.0 | A-1 | 1.3 | F-2 | 3.7 | PS-2 | 2.0 | 100/1.4 | 4.0 | 2.2 |

In Table 2,

S/A: Ratio of silicone oil/amino modified silicone (by weight)

S/F: Parts of higher fatty acid magnesium salt per 100 parts of silicone oil

S/PS: Parts of polyorganosiloxane per 100 parts of silicone oil

S-1: Polydimethylsiloxane with a viscosity of $20\times10^{-6}$ $m^2/S$ at 25° C.

S-2: Polydimethylsiloxane with a viscosity of $10\times10^{-6}$ $m^2/S$ at 25° C.

F-1: Magnesium distearate

F-2: Mixed higher fatty acid magnesium salt of palmitic acid/stearic acid=40/60 (molar ratio)

PS-1: Polyorganosiloxane with remaining silanol groups, produced from tetramethylsilane/trimethylmethoxysilane=25/75 (molar ratio) (silanol group characteristic absorption band 3750 $cm^{-1}$ was detected by FT-IR)

PS-2: Polyorganosiloxane with remaining silanol groups, produced from tetramethylsilne/tripropylmethoxysilane=35/65 (molar ratio) (silanol group characteristic absorption band 3750 cm⁻was detected by FT-IR)

Test class 2 (evaluation and measurement of treatment agents)

The dispersion stability, average particle sizes and zeta potentials of the treatment agents prepared in Test Class 1 were evaluated and measured as described below. The results are shown in Table 4.

Evaluation of dispersion stability 100 ml of a treatment agent was supplied into a 100 ml measuring glass cylinder with a stopper, and allowed to stand at 25° C. for 1 week or 1 month. One week later and one month later, the appearance of the treatment agent was observed and evaluated according to the following criterion:

AA: Homogeneously dispersed state without any change in appearance

A: A less than 5 ml transparent layer was formed.

B: A 5 ml or more transparent layer was formed.

C: Precipitate was formed.

Measurement of average particle size

A sample was prepared by diluting a treatment agent prepared in Test Class 1 to achieve a higher fatty acid magnesium salt concentration of 1000 ppm using the same dispersion medium as that used for preparing the treatment agent. The average particle size of the sample in reference to area was measured using a supercentrifugal automatic particle size distribution measuring instrument (CAPA-700 produced by Horiba Seisakusho).

Measurement of zeta potential

TABLE 3

| | Silicone oil (S) | | Amino modified silicone (A) | | Higher fatty acid magnesium salt (F) | | | | |
|---|---|---|---|---|---|---|---|---|---|
| Treatment | Kind | Amount | Kind | Amount | Kind | Amount | S/A | S/F | S/PS |
| t-1 | s-1 | 95.3 | a-1 | 1.2 | F-1 | 3.5 | 100/1.3 | 3.7 | 0 |
| t-2 | s-1 | 95.3 | a-2 | 1.2 | F-1 | 3.5 | 100/1.3 | 3.7 | 0 |
| t-3 | s-1 | 95.3 | a-3 | 1.2 | F-1 | 3.5 | 100/1.3 | 3.7 | 0 |
| t-4 | s-1 | 98.9 | A-1 | 0.1 | F-1 | 1.0 | 100/0.2 | 1.0 | 0 |
| t-5 | s-1 | 94.5 | A-1 | 4.5 | F-1 | 1.0 | 100/4.8 | 1.1 | 0 |
| t-6 | s-1 | 98.4 | A-1 | 1.1 | F-1 | 0.5 | 100/1.1 | 0.5 | 0 |
| t-7 | s-1 | 99.0 | A-1 | 1.1 | F-1 | 9.9 | 100/1.2 | 11.1 | 0 |
| t-8 | s-1 | 95.3 | A-1 | 1.2 | f-1 | 3.5 | 100/1.3 | 3.7 | 0 |
| t-9 | s-1 | 96.5 | | | F-1 | 3.5 | 100/0 | 3.6 | 0 |

In Table 3,

S-1 - S-3, F-1, F-2, A-1, A-2, PS-1: As stated for Table 2.

f-1: Magnesium dicaprylate

A sample was prepared by diluting a treatment agent prepared in Test Class 1 to achieve a higher fatty acid magnesium salt concentration of 80 ppm using the same dispersion medium as that used for preparing the treatment agent, and dispersing the diluted treatment agent by an ultrasonic bath for 30 seconds. The zeta potential of the sample was measured at 25-C using a zeta potential measuring instrument (Model 501 produced by Penkem).

TABLE 43

| Test No. | Treatment | Dispersion stability: 1 week later | Dispersion stability: 1 month later | Average particle size: Immediately after preparation (μm) | Average particle size: 1 month later (μm) | Zeta potential (mV) |
|---|---|---|---|---|---|---|
| 1 | T-1 | AA | AA | 0.15 | 0.15 | −55 |
| 2 | T-2 | AA | AA | 0.17 | 0.17 | −71 |
| 3 | T-3 | AA | AA | 0.19 | 0.19 | −73 |
| 4 | T-4 | AA | AA | 0.18 | 0.18 | −82 |
| 5 | T-5 | A | A | 0.21 | 0.22 | −41 |
| 6 | T-6 | A | A | 0.23 | 0.23 | −45 |
| 7 | T-7 | AA | AA | 0.18 | 0.18 | −55 |
| 8 | T-8 | AA | AA | 0.18 | 0.19 | −67 |
| 9 | t-1 | A | B | 0.35 | 0.51 | −20 |
| 10 | t-2 | AA | AA | 0.18 | 0.18 | −71 |
| 11 | t-3 | AA | AA | 0.16 | 0.16 | −66 |
| 12 | t-4 | B | C | 0.25 | 0.38 | −5 |
| 13 | t-5 | AA | AA | 0.14 | 0.14 | −74 |
| 14 | t-6 | AA | A | 0.14 | 0.18 | −47 |
| 15 | t-7 | A | A | 6.25 | 0.29 | −48 |
| 16 | t-8 | AA | AA | 0.22 | 0.23 | −67 |
| 17 | t-9 | C | C | 0.65 | 0.85 | 0 |

Test class 3 (Application of treatment agents to elastic polyurethane fibers, and evaluation)

Production of elastic polyurethane fibers and method for applying treatment agents 2 g of polytetramethylene ether glycol with a molecular weight of 2000 and 400 g of bis-(p-isocyanatophenyl)-methane (MDI) was supplied into a nitrogen-sealed stirring reactor, to achieve an addition ratio of 1.60, and reaction was effected at 90° C. for 3 hours, to obtain a capped glycol. Then, 699 g of the capped glycol was dissolved into 1093 g of N,N-dimethylacetamide (DMAC), and at room temperature, a mixture consisting of 11 g of ethylenediamine as a chain extender, 1.6 g of diethylamine as a chain terminator and 195 g of DMAC was added by a high speed stirring machine, for chain extension, to obtain a polymer with a solid content of 35.6 wt %. Titanium oxide, a hindered amine based weather resisting agent and a hindered phenol based antioxidant were added to the polymer solution to achieve 4.7 wt %, 3.0 wt % and 1.2 wt % respectively based on the weight of the polymer solid. The mixture was mixed to obtain a homogeneous polymer mixture. The obtained polymer mixture was spun into a 40-denier elastic yarn consisting of four fibers by a known dry spinning method used for spandex, and a treatment was applied by an oiling roller before winding. The yarn was wound around a 58 mm long cylindrical paper tube via a traverse guide to give a winding width of 38 mm at a winding speed of about 600 m/min.

The amount of the treatment agent deposited was controlled in reference to the weight of the yarn by adjusting the speed of the oiling roller. For evaluating reelability, a 500 g wound sample was used, and for other evaluation, a 100 g wound sample was used. The amount of the treatment agent deposited was measured using n-hexane as an extraction solvent according to JIS-L1073 (Synthetic Fiber and Filament Yarn Testing Methods).

Evaluation and measurement

Evaluation of fiber friction coefficient

Using a measuring instrument shown in FIG. 1, while an initial load was given by a weight 1, a running yarn 2 after a free roller 5 was twisted twice by free rollers 6, 7 and 8. An initial tension ($T_1$) of 2 g was applied (detected by a detector 3), and the yarn was driven to run at a low speed of 0.25 m/min, to measure the secondary tension ($T_2$) (detected by a detector 4), for calculating the friction coefficient from the following formula:

Friction coefficient=$(T_2-T_1)\div(T_2+T_1)$

Evaluation of winding form

Figure 3:
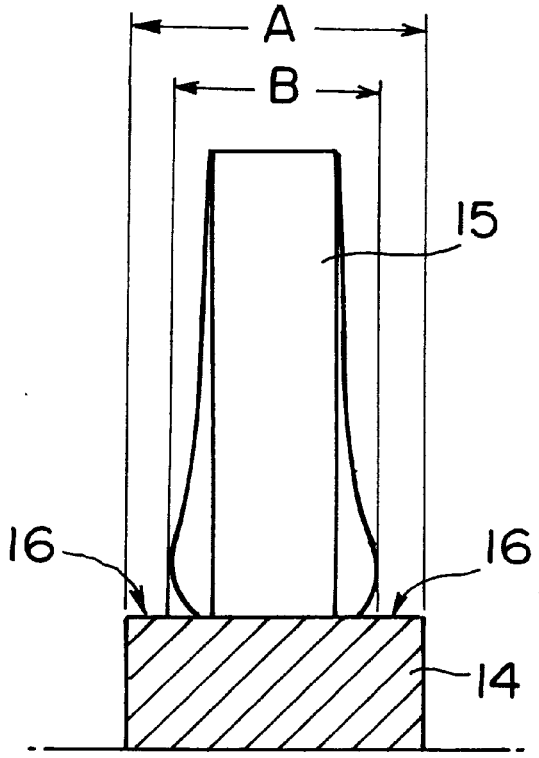
FIG. 3 is an illustration showing a winding form.

FIG. 3 is an illustration showing the winding form of an elastic polyurethane yarn. In general, an elastic polyurethane yarn 15 wound around a cylindrical paper tube 14 is extended in the state of being wound. So, near the core, adjacent yarn segments are likely to slip and are pressed out in the direction perpendicular to the winding direction in the winding form. If this tendency is too intense, the winding width B near the core becomes close to the cylindrical paper tube A, to lessen the winding allowance 16 called freeboard, inconveniencing the handling in subsequent steps. Furthermore, when the elastic polyurethane yarn is installed in an apparatus for advanced processing, the yarn is highly likely to directly touch the apparatus. So, the freeboard shown in FIG. 3 is an important factor. For this reason, to evaluate the winding form, the length of the freeboard was measured, to calculate the freeboard from the following formula. The calculated value was evaluated in reference to the following criterion.

Freeboard=(A−B)/2

A: Freeboard was 4 mm or more.

B: Freeboard was 2 mm to less than 4 mm.

C: Freeboard was less than 2 mm.

Evaluation of reelability

Figure 4:
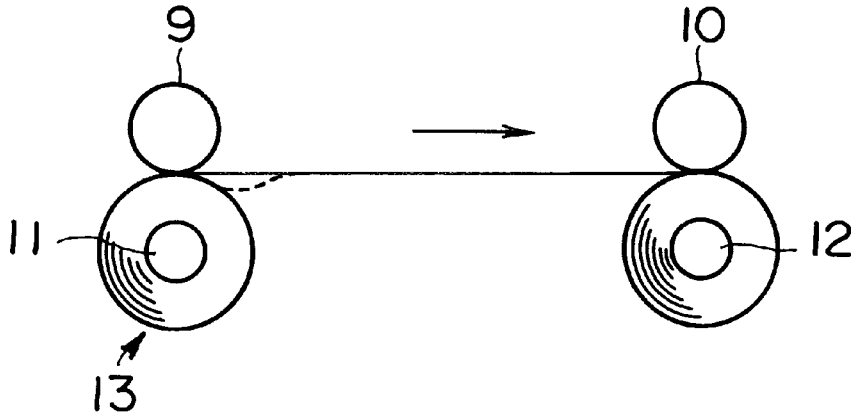
FIG. 4 is a schematic view showing a reelability measuring instrument.

In a reelability measuring instrument shown in FIG. 4, a first drive roller 11 and a first free roller 9 kept in contact with it form a feeder, and a second drive roller 12 and a second free roller 10 kept in contact with it form a winder. The winder was installed away from the feeder by 20 cm in horizontal direction. On the first drive roller 11, a package 13 with 500 g of treated elastic polyurethane fibers wound was installed, and unreeled to a yarn winding thickness of 2 mm, to make a sample. From the sample, the treated elastic polyurethane fibers were wound around the second drive roller 12. The feed rate of the treated elastic polyurethane fibers from the first drive roller 11 was fixed at 50 m/min, and on the other hand, the winding speed of the treated elastic polyurethane fibers around the second drive roller 12 was gradually raised from 50 m/min, to forcibly unreel the treated elastic polyurethane fibers from the package. During the forcible unreeling, the winding speed V (M/min) at the time when the treated elastic polyurethane fibers did not play any more between the feeder and the winder was measured. The reelability (%) was obtained from the following formula and evaluated in reference to the following criterion. The results are shown in Table 5.

Reelability (%)=(V−50)×2

AA: Reelability is less than 125% (No problem at all, allowing stable reeling)

A: Reelability is 125 to less than 135% (Slight resistance in yarn drawing, without any yarn breaking at all, to allow stable reeling)

B: Reelability is 135 to less than 145% (Some resistance in yarn drawing, with some yarn breaking, hence slightly inconveniencing operation)

C: Reelability is 145% or more (large resistance in yarn drawing, with frequent yarn breaking, hence inconveniencing operation)

Evaluation of scum

Ten packages of treated elastic polyurethane fibers were set in a miniature warper, and wound by 30,000 m in an atmosphere of 25° C. and 65% RH at a yarn speed of 200 m/min. In this case, the deposition and accumulation of scum on the comb guide of the miniature warper were visually observed and evaluated in reference to the following criterion. The results are shown in Table 5.

AA: Scum was deposited little.

A: Scum was deposited a little, without disturbing stable yarn running.

B: Scum was deposited and accumulated, disturbing stable yarn running.

C: Scum was deposited and accumulated remarkably, disturbing stable yarn running very much.

Evaluation of electrification control

Ten packages of treated elastic polyurethane fibers were set in a miniature warper and driven to run at a speed of 200 m/min in an atmosphere of 25° C. and 65% RH, to measure the charged voltage of the yarn running between the creel stand and the front roller of the miniature warper, by a charged voltage measuring instrument (collector tube KS-525 produced by Kasuga). The measured value was evaluated in reference to the following criterion. The results are shown in Table 5.

AA: Charged voltage is less than 1 kV (Operation can be effected without any problem at all).

A: Charged voltage was 1 kV to less than 2 kV (Operation can be effected without any problem).

B: Charged voltage was 2 kV to less than 2.5 kV (Some problem in operation).

C: Charged voltage was 2.5 kV or more (Operation cannot be effected).

TABLE 5

| Example | Treat-ment | Deposited amount (%) | Fiber friction coefficient | Winding form | Reelabi-lity (%) | Evaluation of warping: Scum | Evaluation of warping: Elect-ricity control (kV) |
|---|---|---|---|---|---|---|---|
| Example 1 | T-1 | 6.5 | 0.29 | A | AA | AA | A |
| 2 | T-2 | 3.5 | 0.25 | A | AA | AA | A |
| 3 | T-3 | 5.0 | 0.29 | A | AA | A | A |
| 4 | T-4 | 5.0 | 0.29 | A | AA | A | A |
| 5 | T-5 | 5.0 | 0.29 | A | A | A | A |
| 6 | T-6 | 5.0 | 0.29 | A | A | A | A |
| 7 | T-7 | 5.0 | 0.31 | A | AA | AA | AA |
| 8 | T-8 | 5.0 | 0.30 | A | AA | AA | AA |
| Comparative Example 1 | t-1 | 5.0 | 0.27 | A | C | C | C |
| 2 | t-2 | 5.0 | 0.19 | C | C | B | B |
| 3 | t-3 | 5.0 | 0.17 | C | A | B | C |
| 4 | t-4 | 5.0 | 0.27 | A | C | C | B |
| 5 | t-5 | 5.0 | 0.18 | C | A | A | C |
| 6 | t-6 | 5.0 | 0.26 | A | C | A | A |
| 7 | t-7 | 5.0 | 0.24 | A | A | C | A |
| 8 | t-8 | 5.0 | 0.18 | C | C | C | B |
| 9 | t-9 | 5.0 | 0.26 | A | C | C | C |

Example 2

Test Class (Preparation of Treatment Agent)

Preparation of treatment agent T-1

5.0 parts of magnesium distearate (F-1) were added to a silicone mixture consisting of 94.3 parts of a silicone oil (S-1) with a viscosity of $20\times10^{-6}$ $m^2/S$ at 25° C. as a dispersion medium and 0.7 part of the carboxyamide modified silicone (A-1) shown in Table 6, and the mixture was mixed at 20 to 35° C. until it became homogeneous, and wet-ground using a horizontal bead mill, to prepare treatment (T-1) as a dispersion with magnesium distearate (F-1) colloidally dispersed.

Preparation of treatment agents (T-2) to (T-6) and (t-1) to (t-9)

Treatment agents (T-2) to (T-6) and (t-1) to (t-9) were prepared as described for preparing the treatment agent (T-1). The details of these treatment agents are shown in Tables 7 and 8.

Preparation of treatment agent (T-7)

3.5 parts of magnesium distearate (F-1) were added to a silicone mixture consisting of 94.4 parts of the silicone oil (S-1) as a dispersion medium, 1.2 parts of the carboxyamide modified silicone (A-1) as a dispersant and 0.9 part of the polyorganosiloxane (PS-1) shown below Table 7, and the mixture was mixed at 20 to 35° C. until it became homogeneous, and wet-ground using a horizontal bead mill, to prepare treatment agent (T-7) with magnesium distearate (F-1) colloidally dispersed.

Preparation of treatment agent (T-8)

Treatment agent (T-8) was prepared as described for preparing the treatment agent (T-7). The details are shown in Table 7.

Preparation of treatment agent (t-10)

3.5 parts of magnesium distearate (F-1) were added to 96.5 parts of the silicone oil (S-1) used as a dispersion medium, and the mixture was mixed at 20 to 35° C. until it became homogeneous, and wet-ground using a horizontal bead mill, to prepare treatment agent (t-10) with magnesium distearate (F-1) colloidally dispersed.

S/F: Parts of higher fatty acid magnesium salt per 100 parts of silicone oil

S/PS: Parts of polyorganosiloxane per 100 parts of silicone oil

S-1: Polydimethylsiloxane with a viscosity of $20\times10^{-6}$ $m^2/S$ at 25° C.

S-2: Polydimethylsiloxane with a viscosity of $10\times10^{-6}$ $m^2/S$ at 25° C.

F-1: Magnesium distearate

F-2: Mixed higher fatty acid magnesium salt of palmitic acid/stearic acid=40/60 (molar ratio)

PS-1: Polyorganosiloxane with remaining silanol groups, produced from tetramethylsilane/trimethylmethoxysilane=50/50 (molar ratio) (Silanol group characteristic absorption band 3750 $cm^{-1}$ was detected by FT-IR).

TABLE 6

| | Carboxyamide modified silicone represented by formula 1 | | | | | | | | |
|---|---|---|---|---|---|---|---|---|---|
| Symbol | a | b | c | d | $X^1$ | $X^2$ | $X^3$ | $R^1$ | $R^2$ |
| A-1 | 80 | 0 | 0 | 2 | Methyl group | Methyl group | CD-1 | — | — |
| A-2 | 150 | 0 | 4 | 5 | Methyl group | Methyl group | CD-1 | — | AM-1 |
| A-3 | 300 | 5 | 1 | 10 | Methyl group | Methyl group | CD-1 | Phenyl group | AM-1 |
| A-4 | 570 | 0 | 3 | 15 | Methyl group | Methyl group | CD-1 | — | AM-1 |
| A-5 | 150 | 0 | 0 | 0 | CD-2 | CD-2 | — | — | — |
| A-6 | 160 | 0 | 1 | 9 | CD-2 | CD-2 | CD-2 | — | AM-2 |
| a-1 | 20 | 0 | 0 | 2 | Methyl group | Methyl group | CD-1 | — | — |
| a-2 | 700 | 0 | 0 | 3 | Methyl group | Methyl group | CD-1 | — | — |
| a-3 | 300 | 0 | 10 | 5 | Methyl group | Methyl group | CD-1 | — | AM-1 |
| a-4 | 300 | 0 | 5 | 25 | Methyl group | Methyl group | CD-1 | — | AM-1 |

In Table 6,

CD-1: $—C_3H_6—NH—C_2H_4—NHCO—C_4H_8COOH$

CD-2: $—C_3H_6—NHCO—C_2H_6COOH$

AM-1: $—C_3H_6—NH-C_2H_4—NH_2$

AM-2: $—C_3H_6—NH_2$

PS-2: Polyorganosiloxane with remaining silanol groups, produced from tetramethylsilane/tripropylmethoxysilane=35/65 (molar ratio) (Silanol group characteristic absorption band 3750 cm⁻was detected by FT-IR).

TABLE 7

| | Silicone oil (S) | | Carboxyamide modified silicone (A) | | Higher fatty acid magnesium salt (F) | | Polyorganosi loxane (PS | | | | |
|---|---|---|---|---|---|---|---|---|---|---|---|
| Treatment | Kind | Amount | Kind | Amount | Kind | Amount | Kind | Amount | S/A | S/F | S/PS |
| T-1 | S-1 | 94.3 | A-1 | 0.7 | F-1 | 5.0 | — | — | 100/0.7 | 5.3 | 0 |
| T-2 | S-2 | 95.3 | A-2 | 1.2 | F-1 | 3.5 | — | — | 100/1.3 | 3.7 | 0 |
| T-3 | S-1 | 95.6 | A-3 | 0.7 | F-2 | 3.7 | — | — | 100/0.7 | 3.9 | 0 |
| T-4 | S-1 | 94.3 | A-4 | 0.7 | F-1 | 5.0 | — | — | 100/0.7 | 5.3 | 0 |
| T-5 | S-1 | 95.4 | A-5 | 0.7 | F-1 | 3.9 | — | — | 100/0.7 | 4.1 | 0 |
| T-6 | S-1 | 95.4 | A-6 | 0.7 | F-1 | 3.9 | — | — | 100/0.7 | 4.1 | 0 |
| T-7 | S-1 | 94.4 | A-1 | 1.2 | F-1 | 3.5 | PS-1 | 0.9 | 100/1.3 | 3.7 | 1.0 |
| T-9 | S-2 | 93.0 | A-1 | 1.3 | F-2 | 3.7 | PS-2 | 2.0 | 100/1.4 | 4.0 | 2.2 |

In Table 7,

S/A: Ratio of silicone oil/carboxyamide modified silicone (by weight)

TABLE 8

| Treatment | Silicone oil (S) Kind | Silicone oil (S) Amount | Carboxyamide modified silicone (A) Kind | Carboxyamide modified silicone (A) Amount | Higher fatty acid magnesium salt (F) Kind | Higher fatty acid magnesium salt (F) Amount | S/A | S/F | S/PS |
|---|---|---|---|---|---|---|---|---|---|
| t-1 | S-1 | 95.3 | a-1 | 1.2 | F-1 | 3.5 | 100/1.3 | 3.7 | 0 |
| t-2 | S-1 | 95.3 | a-2 | 1.2 | F-1 | 3.5 | 100/1.3 | 3.7 | 0 |
| t-4 | S-1 | 95.3 | a-3 | 1.2 | F-1 | 3.5 | 100/1.3 | 3.7 | 0 |
| t-3 | S-1 | 95.3 | a-4 | 1.2 | F-1 | 3.5 | 100/1.3 | 3.7 | 0 |
| t-5 | S-1 | 98.995 | A-1 | 0.005 | F-1 | 1.0 | 100/0.005 | 1.0 | 0 |
| t-6 | S-1 | 87.0 | A-1 | 12.0 | F-1 | 1.0 | 100/13.8 | 1.1 | 0 |
| t-7 | S-1 | 98.4 | A-1 | 1.1 | F-1 | 0.5 | 100/1.1 | 0.5 | 0 |
| t-8 | S-1 | 89.0 | A-1 | 1.1 | F-1 | 9.9 | 100/1.2 | 11.1 | 0 |
| t-9 | S-1 | 95.3 | A-1 | 1.2 | f-1 | 3.5 | 100/1.3 | 3.7 | 0 |
| t-10 | S-1 | 96.5 | — | F-1 | 3.5 | 100/0 | 3.6 | 0 | |

In Table 8,

S-1, F-1: As stated for Table 7 f-1: Magnesium dicaprylate

Test class 2 (evaluation and measurement of treatment agents)

The dispersion stability and average particle sizes of the treatment agents prepared in Test Class 1 were evaluated and measured as described for Example 1. The results are shown in Table 9.

TABLE 9

| Test No. | Treatment | Dispersion stability 1 week later | Dispersion stability 1 month later | Average particle size Immediately after preparation (μm) | Average particle size 1 month later (μm) |
|---|---|---|---|---|---|
| 1 | T-1 | AA | A | 0.23 | 0.23 |
| 2 | T-2 | AA | AA | 0.17 | 0.17 |
| 3 | T-3 | AA | AA | 0.19 | 0.19 |
| 4 | T-4 | AA | AA | 0.19 | 0.18 |
| 5 | T-5 | AA | A | 0.21 | 0.22 |
| 6 | T-6 | AA | AA | 0.15 | 0.15 |
| 7 | T-7 | AA | A | 0.21 | 0.21 |
| 8 | T-9 | AA | A | 0.20 | 0.20 |
| 9 | t-1 | AA | B | 0.35 | 0.51 |
| 10 | t-2 | AA | AA | 0.19 | 0.19 |
| 11 | t-3 | AA | AA | 0.16 | 0.16 |
| 12 | t-4 | AA | AA | 0.15 | 0.15 |
| 13 | t-5 | B | C | 0.25 | 0.26 |
| 14 | t-6 | AA | AA | 0.14 | 0.14 |
| 15 | t-7 | AA | AA | 0.14 | 0.14 |
| 16 | t-8 | AA | A | 0.25 | 0.29 |
| 17 | t-9 | B | C | 0.22 | 0.51 |
| 18 | t-10 | C | C | 0.65 | 0.85 |

Test class 3 (Application of treatment agents to elastic polyurethane fibers, and evaluation)

Production of elastic polyurethane fibers and method of applying treatment agents A mixture of bis-(p-isocyanatophenyl)-methane/tetramethylene ether glycol (number average molecular weight 1800)=1.58/1 (molar ratio) was caused to react at 90° C. for 3 hours according to a conventional method, to prepare a capped glycol. The capped glycol was diluted by N,N-dimethylacetamide (DMAc). Then, a DMAc solution containing ethylenediamine and diethylamine was added to the capped glycol DMAc solution, and the mixture was mixed at room temperature using a high speed stirring machine, for chain extension. Furthermore, DMAc was added, to obtain a DMAc solution with about 35 wt % of a polymer dissolved. Titanium oxide, a hindered amine based weather resisting agent and a hindered phenol based antioxidant were added to the obtained polymer DMAc solution to achieve 4.7 wt %, 3.0 wt % and 1.2 wt % respectively based on the weight of the polymer. The obtained polymer mixture was spun into a 40-denier elastic yarn consisting of four fibers by a known dry spinning method used for spandex, and a treatment agent was applied by an oiling roller before winding. The yarn was wound around a 58 mm long cylindrical tube via a traverse guide to give a winding width of 38 mm at a winding speed of about 600 m/min. The amount of the treatment agent deposited was controlled based on the weight of the yarn by adjusting the speed of the oiling roller. For evaluation of reelability, a 500 g wound sample was used, and for other evaluation, a 100 g wound sample was used. The amount of the treatment agent deposited was the amount extracted using n-hexane as an extraction solvent according to JIS L 1073 (Synthetic Fiber and Filament Yarn Testing Methods).

Evaluation and measurement

Evaluation of fiber friction coefficient

The friction coefficient was calculated as described for Example 1.

Evaluation of metal friction coefficient

Figure 2:
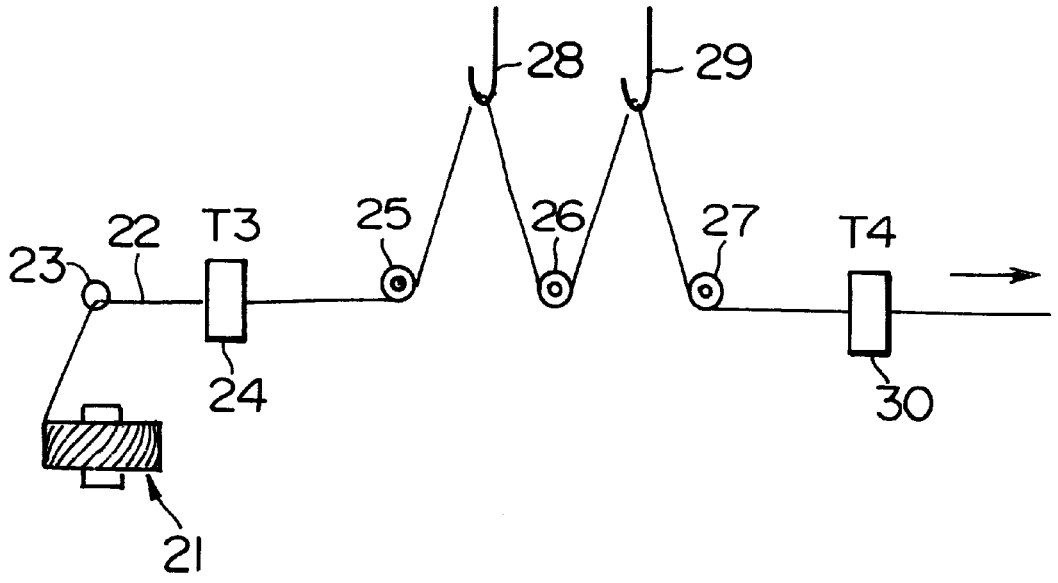
FIG. 2 is a schematic view showing a metal friction coefficient measuring instrument.

Using a measuring instrument shown in FIG. 2, a yarn 22 unwound from a package 21 was passed through a guide 23, and an initial tension ($T_3$) of 10 g was applied (detected by a detector 24), and hooked by two metallic hooks 28 and 29 on its way through free rollers 25, 26 and 27, to run at a speed of 100 m/min. In this state, the secondary tension ($T_4$) was measured by a detector 30, and the friction coefficient was calculated from the following formula:

$$\text{Friction coefficient}=(T_4-T_3)\div(T_3+T_4)$$

Evaluation of winding form

Evaluated as described for Example 1.

Evaluation of reelability

Evaluated as described for Example 1. The results are shown in Table 10.

Evaluation of scum

Evaluated as described for Example 1, except that the packages were wound by 110,000 m. The results are shown in Table 10.

Evaluation of electrification control

Evaluated as described for Example 1, except that 620 packages were set in a miniature warper. The results are shown in Table 10.

TABLE 10

| Example | Treat-ment | Deposited amount (%) | Fiber friction coefficient | Metal friction coefficient | Winding form | Reelabi-lity (%) | Evaluation of warping: Scum | Evaluation of warping: Elect-ricity control (kV) |
|---|---|---|---|---|---|---|---|---|
| Example 1 | T-1 | 6.5 | 0.28 | 0.18 | A | AA | A | A |
| 2 | T-2 | 3.5 | 0.26 | 0.17 | A | AA | AA | A |
| 3 | T-3 | 5.0 | 0.25 | 0.15 | A | AA | AA | A |
| 4 | T-4 | 5.0 | 0.25 | 0.15 | A | AA | AA | A |
| 5 | T-5 | 5.0 | 0.27 | 0.19 | A | A | A | A |
| 6 | T-6 | 5.0 | 0.28 | 0.16 | A | A | A | A |
| 7 | T-7 | 5.0 | 0.29 | 0.18 | A | AA | AA | AA |
| 8 | T-8 | 5.0 | 0.30 | 0.20 | A | AA | AA | AA |
| Comparative Example 1 | t-1 | 5.0 | 0.27 | 0.23 | A | B | C | C |
| 2 | t-2 | 5.0 | 0.19 | 0.19 | C | A | C | B |
| 3 | t-3 | 5.0 | 0.17 | 0.17 | C | A | C | C |
| 4 | t-4 | 5.0 | 0.17 | 0.15 | C | A | C | C |
| 5 | t-5 | 5.0 | 0.27 | 0.24 | A | C | C | B |
| 6 | t-6 | 5.0 | 0.18 | 0.15 | C | A | A | C |
| 7 | t-7 | 5.0 | 0.26 | 0.20 | A | C | A | A |
| 8 | t-8 | 5.0 | 0.24 | 0.18 | A | A | A | A |
| 9 | t-9 | 5.0 | 0.28 | 0.23 | C | C | C | B |
| 10 | t-10 | 5.0 | 0.29 | 0.24 | A | C | C | C |

Example 3

Test class 1 (preparation of treatment agent)

Preparation of treatment agent T-1

5.0 parts of magnesium distearate (F-1) were added to a silicone mixture consisting of 94.2 parts of a silicone oil (S-1) with a viscosity of $20\times10^{-6}$ $m^2/S$ at 25° C. as a dispersion medium and 0.7 part of the amino modified silicone (A-1) shown in Table 11 as a dispersant and 0.1 part of succinic anhydride (C-1), and the mixture was mixed at 20 to 35° C. until it became homogeneous, and wet-ground using a horizontal bead mill, to prepare treatment agent (T-1) as a dispersion with magnesium stearate (F-1) colloidally dispersed.

Preparation of treatment agents (T-2) to (T-6) and (t-1) to (t-10)

Treatment agents (T-2) to (T-6) and (t-1) to (t-10) were prepared as described for preparing the treatment agent (T-1). The details of the treatment agents are shown in Tables 12 and 13.

Preparation of treatment agent (T-7)

4.0 parts of magnesium distearate (F-1) were added to a silicone mixture consisting of 94.2 parts of the silicone oil (S-1) as a dispersion medium, 0.7 part of the amino modified silicone (A-1) as a dispersing agent, 0.1 part of succinic anhydride (C-1) and 1.0 part of the polyorganosiloxane (PS-1) shown in Table 12, and the mixture was mixed at 20 to 35° C. until it became homogeneous, and wet-ground using a horizontal bead mill, to prepare treatment agent (T-7) with magnesium distearate (F-1) colloidally dispersed.

Preparation of treatment agent (T-8)

Treatment agent (T-8) was prepared as described for preparing the treatment agent (T-7). The details are shown in Table 12.

Preparation of treatment agent (t-11)

3.5 parts of magnesium distearate (F-1) were added to 96.5 parts of the silicone oil (S-1) used as a dispersion medium, and the mixture was mixed at 20 to 35° C. until it became homogeneous, and wet-ground using a horizontal bead mill, to prepare treatment agent (t-11) with magnesium distearate (F-1) colloidally dispersed.

TABLE 11

| Symbol | Amino modified silicone: a | b | c | $X^1$ | $X^2$ | $X^3$ | $R^1$ |
|---|---|---|---|---|---|---|---|
| A-1 | 180 | 0 | 1 | Methyl group | Methyl group | AM-1 | — |
| A-2 | 110 | 0 | 4 | Methyl group | Methyl group | AM-1 | — |
| A-3 | 50 | 5 | 1 | Methyl group | Methyl group | AM-1 | n-propyl group |
| A-4 | 360 | 0 | 3 | Methyl group | Methyl group | AM-2 | — |
| A-5 | 180 | 50 | 0 | AM-2 | AM-2 | — | Phenyl group |
| A-6 | 30 | 0 | 0 | AM-2 | AM-2 | — | — |
| a-1 | 20 | 0 | 1 | Methyl group | Methyl group | AM-1 | — |
| a-2 | 500 | 0 | 3 | Methyl group | Methyl group | AM-1 | — |
| a-3 | 100 | 0 | 20 | Methyl group | Methyl group | AM-1 | — |

In Table 11,

AM-1: $—C_3H_6—NH—C_2H_4—NH_2$

AM-2: $—C_3H_6—NH_2$

TABLE 12

| | Silicone oil (S) | | Amino modified silicone (A) | | Organic carboxylic acid (C) | | Higher fatty acid magnesium salt (F) | | Polyorganosi loxane (PS) | | S/ | | | |
|---|---|---|---|---|---|---|---|---|---|---|---|---|---|---|
| Treatment | Kind | Amount | Kind | Amount | Kind | Amount | Kind | Amount | Kind | Amount | (A + c) | A/c | S/F | S/PS |
| T-1 | S-1 | 94.2 | A-1 | 0.7 | c-1 | 0.1 | F-1 | 5.0 | — | — | 0.8 | 14.3 | 5.3 | — |
| T-2 | S-2 | 95.2 | A-2 | 1.2 | c-1 | 0.1 | F-1 | 3.5 | — | — | 1.4 | 8.3 | 3.7 | — |
| T-3 | S-1 | 95.5 | A-3 | 0.7 | c-1 | 0.1 | F-2 | 3.7 | — | — | 0.8 | 14.3 | 3.9 | — |
| T-4 | S-1 | 94.2 | A-4 | 0.7 | c-2 | 0.1 | F-1 | 5.0 | — | — | 0.8 | 14.3 | 5.3 | — |
| T-5 | S-1 | 95.2 | A-5 | 0.7 | c-3 | 0.2 | F-1 | 3.9 | — | — | 0.9 | 28.6 | 4.1 | — |
| T-6 | S-1 | 94.9 | A-6 | 0.7 | c-3 | 0.5 | F-1 | 3.9 | — | — | 0.7 | 71.4 | 4.1 | — |
| T-7 | S-1 | 94.2 | A-1 | 0.7 | c-1 | 0.i | F-1 | 4.0 | PS-1 | 1.0 | 0.8 | 14.3 | 4.2 | 1.1 |
| T-8 | S-2 | 92.5 | A-1 | 1.2 | c-i | 0.1 | F-2 | 2.0 | PS-2 | 1.5 | 1.4 | 8.3 | 2.2 | 1.6 |

In Table 12,

S/(A+c): Rate of total of amino modified silicone and organic carboxylic acid per 100 parts of silicone oil (ratio by weight)

A/c: Parts of organic carboxylic acid per 100 parts of amino modified silicone

S/F: Parts of higher fatty acid magnesium salt per 100 parts of silicone oil

S/PS: Parts of polyorganosiloxane per 100 parts of silicone oil

S-1: Polydimethylsiloxane with a viscosity of $20\times10^{-6}$ $m^2/S$ at 25° C.

S-2: Polydimethylsiloxane with a viscosity of $10\times10^{-6}$ $m^2/S$ at 25° C.

c-1: Succinic anhydride c-2: Maleic acid c-3: Adipic acid

F-1: Magnesium disterate

F-2: Mixed higher fatty acid magnesium salt of palmitic acid/stearic acid=40/60 (molar ratio)

PS-1: Polyorganosiloxane with remaining silanol groups, produced from tetramethylsilane/trimethylmethoxysilane=50/50 (molar ratio) (Silanol group characteristic absorption band 3750 $cm^{-1}$ was detected by FT-IR)

PS-2: Polyorganosiloxane produced with remaining silanol groups, produced from tetramethylsilane/tripropylmethoxysilane=35/65 (molar ratio) (Silanol group characteristic absorption band 3750 $cm^{-1}$ was detected by FT-IR)

TABLE 13

| | Silicone oil (S) | | Amino modified silicone (A) | | Organic carboxylic acid (c) | | Higher fatty acid magnesium salt (F) | | S/ | | |
|---|---|---|---|---|---|---|---|---|---|---|---|
| Treatment | Kind | Amount | Kind | Amount | Kind | Amount | Kind | Amount | (A + c) | A/c | S/F |
| t-1 | S-1 | 94.2 | a-1 | 0.7 | c-1 | 0.1 | F-1 | 5.0 | 0.8 | 14.3 | 5.3 |
| t-2 | S-1 | 94.2 | a-2 | 0.7 | c-1 | 0.1 | F-1 | 5.0 | 0.8 | 14.3 | 5.3 |
| t-3 | S-1 | 94.2 | a-3 | 0.7 | c-1 | 0.1 | F-1 | 5.0 | 0.8 | 14.3 | 5.3 |
| t-4 | S-1 | 94.7 | A-1 | 0.2 | c-1 | 0.1 | F-1 | 5.0 | 0.2 | 50.0 | 5.3 |
| t-5 | S-1 | 92.0 | A-1 | 4.5 | c-1 | 0.5 | F-1 | 3.0 | 5.4 | 11.1 | 3.3 |
| t-6 | S-1 | 93.97 | A-1 | 3.0 | c-1 | 0.03 | F-1 | 3.0 | 3.2 | 1.0 | 3.2 |
| t-7 | S-1 | 96.1 | A-1 | 0.4 | c-1 | 0.5 | F-1 | 3.0 | 0.9 | 125.0 | 3.1 |
| t-8 | S-1 | 98.7 | A-1 | 0.7 | c-1 | 0.1 | F-1 | 0.5 | 0.8 | 14.3 | 0.5 |
| t-9 | S-1 | 89.3 | A-1 | 0.7 | c-1 | 0.1 | F-1 | 9.9 | 0.9 | 14.3 | 11.I |
| t-10 | S-1 | 94.2 | A-1 | 0.7 | c-1 | 0.1 | f-1 | 5.0 | 0.8 | 14.3 | 5.3 |
| t-11 | S-1 | 96.5 | | | | | F-1 | 3.5 | — | | 3.6 |

S-1, c-1, F-1: As stated for Table 12 f-1: Magnesium dicaprylate

Test class 2 (evaluation and measurement of treatment agents)

The dispersion stability, average particle sizes and zeta potentials of the treatment agents prepared in Test Class 1 were evaluated and measured as described below. The results are shown in Table 14.

Evaluation of dispersion stability

Evaluated according to the same method as in Example 1.

Evaluation of viscosity property 100 g of elastic polyurethane fibers spun without any treatment agent deposited were immersed in 1 liter of a treatment agent at room temperature for 1 week, and the elastic polyurethane fibers and the treatment agent were separated, to recover the treatment agent used for immersion. The viscosities of the treatment agent before and after immersion were measured using a Brookfield viscometer (rotor speed: 6 rpm). The measured values were evaluated in reference to the following criterion.

A: The increment of viscosity after immersion was less than 10% of the viscosity before immersion.

B: The increment of viscosity after immersion was 10% to less than 20% of the viscosity before immersion.

C: The increment of viscosity after immersion was 20% or more of the viscosity before immersion.

Measurement of average particle size

The average particle size was measured as described for Example 1.

Measurement of zeta potential

The zeta potential was measured as described for Example 1.

Evaluation of winding form

Evaluated as described for Example 1

Evaluation of reelability

Evaluated as described for Example 1. The results are shown in Table 15.

Evaluation of scum

TABLE 14

| Test No. | Treatment | Dispersion stability: 1 week later | Dispersion stability: 1 month later | Viscosity property | Average particle size: Immediately after preparation (μm) | Average particle size: 1 month later (μm) | Zeta potential (mV) |
|---|---|---|---|---|---|---|---|
| 1 | T-1 | AA | AA | A | 0.15 | 0.15 | −65 |
| 2 | T-2 | AA | AA | A | 0.17 | 0.17 | −73 |
| 3 | T-3 | AA | AA | A | 0.19 | 0.19 | −69 |
| 4 | T-4 | AA | AA | A | 0.19 | 0.16 | −76 |
| 5 | T-5 | A | A | A | 0.21 | 0.22 | −43 |
| 6 | T-6 | A | A | A | 0.23 | 0.23 | −50 |
| 7 | T-7 | AA | AA | A | 0.18 | 0.16 | −52 |
| 8 | T-6 | AA | AA | A | 0.16 | 0.19 | −71 |
| 9 | t-1 | A | B | A | 0.35 | 0.51 | −23 |
| 10 | t-2 | AA | AA | A | 0.18 | 0.18 | −68 |
| 11 | t-3 | AA | AA | B | 0.16 | 0.16 | −67 |
| 12 | t-4 | B | C | A | 0.25 | 0.26 | −8 |
| 13 | t-5 | AA | AA | A | 0.20 | 0.20 | −35 |
| 14 | t-6 | AA | AA | C | 0.14 | 0.14 | −75 |
| 15 | t-7 | A | B | A | 0.27 | 0.35 | −41 |
| 16 | t-9 | AA | AA | A | 0.14 | 0.14 | −51 |
| 17 | t-9 | A | A | C | 0.25 | 0.29 | −48 |
| 18 | t-10 | AA | AA | A | 0.22 | 0.23 | −64 |
| 19 | t-11 | C | C | A | 0.65 | 0.65 | 0 |

Test class 3 (Application of treatment agents to elastic polyurethane fibers, and evaluation)

Production of elastic polyurethane fibers and method of applying treatment agents Elastic polyurethane fibers were produced as described for Example 2, and treatment agents were applied.

Evaluation and measurement

Evaluation of fiber friction coefficient

The friction coefficient was calculated as described for Example 1.

Evaluated as described for Example 1. The results are shown in Table 15.

Evaluation of electrification control

Evaluated as described for Example 1. The results are shown in Table 15.

TABLE 15

| Example | Treatment | Deposited amount (%) | Fiber friction coefficient | Winding form | Reelability (%) | Evaluation of warping: Scum | Evaluation of warping: Electricity control (kV) |
|---|---|---|---|---|---|---|---|
| Example 1 | T-1 | 6.5 | 0.28 | A | AA | AA | A |
| 2 | T-2 | 3.5 | 0.25 | A | AA | AA | A |
| 3 | T-3 | 5.0 | 0.29 | A | AA | A | A |
| 4 | T-4 | 5.0 | 0.27 | A | AA | A | A |
| 5 | T-5 | 5.0 | 0.29 | A | A | A | A |
| 6 | T-6 | 5.0 | 0.29 | A | A | A | A |
| 7 | T-7 | 5.0 | 0.31 | A | AA | AA | AA |
| 8 | T-8 | 5.0 | 0.30 | A | AA | AA | AA |
| Comparative example 1 | t-1 | 5.0 | 0.27 | A | C | C | C |
| 2 | t-2 | 5.0 | 0.19 | C | C | C | B |
| 3 | t-3 | 5.0 | 0.17 | C | A | C | C |
| 4 | t-4 | 5.0 | 0.27 | A | C | A | B |
| 5 | t-5 | 5.0 | 0.17 | C | C | C | C |
| 6 | t-6 | 5.0 | 0.19 | C | A | A | C |
| 7 | t-7 | 5.0 | 0.29 | A | C | C | C |
| 8 | t-9 | 5.0 | 0.26 | A | C | A | A |

TABLE 15-continued

| Example | Treat-ment | Deposited amount (%) | Fiber friction coefficient | Winding form | Reelabi-lity (%) | Evaluation of warping: Scum | Evaluation of warping: Elect-ricity control (kV) |
|---|---|---|---|---|---|---|---|
| 9 | t-9 | 5.0 | 0.24 | A | C | C | A |
| 10 | t-10 | 5.0 | 0.18 | A | C | C | B |
| 11 | t-11 | 5.0 | 0.26 | A | C | C | C |

Example 4

Test Class 1 (Preparation of Treatment Agents)

Preparation of treatment agent T-1

5.0 parts of magnesium distearate (F-1) were added to a silicone mixture consisting of 94.2 parts of a silicone oil (S-1) with a viscosity of $20\times10^{-6}$ $m^2/S$ at 25° C. as a dispersion medium, 0.7 part of the amino modified silicone (A-1) shown in Table 16 and 0.1 part of the carboxy modified silicone (B-1) shown in Table 17, and the mixture was mixed at 20 to 35° C. until it became homogeneous, and wet-ground using a horizontal bead mill, to prepare treatment agent (T-1) as a dispersion with magnesium distearate (F-1) colloidally dispersed.

Preparation of treatment agents (T-2) to (T-6) and (t-1) to (t-8)

Treatment agents (T-2) to (T-6) and (t-1) to (t-8) were prepared as described for preparing the treatment agent (T-1). The details of the treatment agents are shown in Tables 18 and 19.

Preparation of treatment agent (T-7)

3.5 parts of magnesium distearate (F-1) were added to a silicone mixture consisting of 94.36 parts of the silicone oil (S-1) as a dispersion medium, 1.2 parts of the amino modified silicone (A-1) shown in Table 16, 0.04 part of the carboxy modified silicone (B-1) shown in Table 17 and 0.9 part of the polyorganosiloxane (PS-1) shown below Table 18, and the mixture was mixed at 20 to 35° C. until it became homogeneous, and wet-ground using a horizontal bead mill, to prepare treatment agent (T-7) with magnesium distearate (F-1) colloidally dispersed.

Preparation of treatment agent (T-8)

Treatment agent (T-8) was prepared as described for preparing treatment agent (T-7). The details are shown in Table 18.

Preparation of treatment agent (t-9)

3.5 parts magnesium distearate (F-1) were added to 96.5 parts of the silicone oil (S-1) used as a dispersion medium, and the mixture was mixed at 20 to 35° C. until it became homogenous, and wet-ground using a horizontal bead mill, to prepare treatment agent (t-9) with magnesium distearate (F-1) colloidally dispersed. The details are shown in Table 19.

TABLE 16

| Symbol | Amino modified silicone: a | b | c | $X^1$ | $X^2$ | $X^3$ | $R^1$ |
|---|---|---|---|---|---|---|---|
| A-1 | 180 | 0 | 1 | Methyl group | Methyl group | AM-1 | — |
| A-2 | 110 | 0 | 4 | Methyl group | Methyl group | AM-1 | — |
| A-3 | 50 | 5 | 1 | Methyl group | Methyl group | AM-1 | n-propyl group |
| A-4 | 360 | 0 | 3 | Methyl group | Methyl group | AM-2 | — |
| A-5 | 180 | 50 | 2 | AM-2 | AM-2 | AM-2 | Phenyl group |
| A-6 | 30 | 0 | 0 | AM-2 | AM-2 | — | — |
| a-1 | 20 | 0 | 1 | Methyl group | Methyl group | AM-1 | — |
| a-2 | 500 | 0 | 3 | Methyl group | Methyl group | AM-1 | — |
| a-3 | 100 | 0 | 20 | Methyl group | Methyl group | AM-1 | — |

In Table 16,

AM-1: $—C_3H_6—NH-C_2H_4—NH_2$

AM-2: $—C_3H_6—NH_2$

TABLE 17

| Symbol | Carboxy modified silicone: e | f | g | $X^4$ | $X^5$ | $X^6$ | $R^2$ |
|---|---|---|---|---|---|---|---|
| B-1 | 30 | 0 | 2 | Methyl group | Methyl group | CS-1 | — |
| B-2 | 300 | 0 | 9 | Methyl group | Methyl group | CS-1 | — |
| B-3 | 400 | 350 | 19 | Methyl group | Methyl group | CS-1 | n-propyl group |
| B-4 | 50 | 0 | 5 | Methyl group | Methyl group | CS-1 | — |
| B-5 | 200 | 10 | 0 | CS-1 | CS-1 | — | Phenyl group |
| B-6 | 200 | 0 | 2 | CS-1 | CS-1 | CS-1 | — |

TABLE 17-continued

| | Carboxy modified silicone | | | | | | |
|---|---|---|---|---|---|---|---|
| Symbol | e | f | g | $X^4$ | $X^5$ | $X^6$ | $R^2$ |
| b-1 | 20 | 0 | 2 | Methyl group | Methyl group | CS-1 | — |
| b-2 | 1000 | 0 | 3 | Methyl group | Methyl group | CS-1 | — |
| b-3 | 100 | 0 | 20 | Methyl group | Methyl group | CS-1 | — |

In Table 17,

CS-1: —$C_3H_6$—COOH

TABLE 18

| | Silicone oil (S) | | Amino modified silicone (A) | | Carboxy modified silicone (B) | | Higher fatty acid magnesium salt (F) | | Polyorganosiloxane (PS) | | | | | |
|---|---|---|---|---|---|---|---|---|---|---|---|---|---|---|
| Treatment | Kind | Amount | Kind | Amount | Kind | Amount | Kind | Amount | Kind | Amount | S/A | A/B | S/F | S/SP |
| T-1 | S-1 | 94.2 | A-1 | 0.7 | B-1 | 0.1 | F-1 | 5.0 | — | — | 0.7 | 14.3 | 5.3 | 0 |
| T-2 | S-2 | 95.2 | A-2 | 1.2 | B-2 | 0.1 | F-1 | 3.5 | — | — | 1.3 | 8.3 | 3.7 | 0 |
| T-3 | S-1 | 95.6 | A-3 | 0.7 | B-3 | 0.1 | F-2 | 3.7 | — | — | 0.7 | 14.3 | 3.9 | 0 |
| T-4 | S-1 | 94.2 | A-4 | 0.7 | B-4 | 0.1 | F-1 | 5.0 | — | — | 0.7 | 14.3 | 5.3 | 0 |
| T-5 | S-1 | 95.2 | A-5 | 0.7 | B-5 | 0.2 | F-1 | 3.9 | — | — | 0.7 | 28.6 | 4.1 | 0 |
| T-6 | S-1 | 94.7 | A-6 | 0.7 | B-6 | 0.7 | F-1 | 3.9 | — | — | 0.7 | 100 | 4.1 | 0 |
| T-7 | S-1 | 94.36 | A-1 | 1.2 | B-1 | 0.04 | F-1 | 3.5 | PS-1 | 0.9 | 1.3 | 3.4 | 3.7 | 1.0 |
| T-8 | S-2 | 92.5 | A-1 | 1.3 | B-1 | 0.5 | F-2 | 3.7 | PS-2 | 2.0 | 1.4 | 38.5 | 4.0 | 2.2 |

In Table 18,

S/A: Rate of total of amino modified silicone and carboxy modified silicone per 100 parts of silicone oil (ratio by weight)

A/B: Parts of carboxy modified silicone per 100 parts of amino modified silicone S/F: Parts of higher fatty acid magnesium salt per 100 parts of silicone oil S/PS: Parts of polyorganosiloxane per 100 parts of silicone oil S-1: Polydimethylsiloxane with a viscosity of $20\times10^{-6}$ $m^2/S$ at 25° C.

trimethylmethoxysilane=50/50 (molar ratio) (Silanol group characteristic absorption band 3750 $cm^{-1}$ was detected by FT-IR)

PS-2: Polyorganosiloxane with remaining silanol groups, produced from tetramethylsilane/tripropylmethoxysilane=35/65 (molar ratio) (Silano group characteristic absorption band 3750 $cm^{-1}$ was detected by FT-IR)

TABLE 19

| | Silicone oil (S) | | Amino modified silicone (A) | | Carboxy modified silicone (B) | | Higher fatty acid magnesium salt (F) | | | | |
|---|---|---|---|---|---|---|---|---|---|---|---|
| Treatment | Kind | Amount | Kind | Amount | Kind | Amount | Kind | Amount | S/A | A/B | S/F |
| t-1 | S-1 | 95.2 | a-1 | 1.2 | B-1 | 0.i | F-1 | 3.5 | 1.3 | 8.3 | 3.7 |
| t-2 | S-1 | 95.2 | a-2 | 1.2 | B-1 | 0.1 | F-1 | 3.5 | 1.3 | 8.3 | 3.7 |
| t-3 | S-1 | 95.2 | a-3 | 1.2 | B-1 | 1.0 | F-1 | 3.5 | 1.3 | 6.3 | 3.7 |
| t-4 | S-1 | 98.8 | A-1 | 0.1 | B-1 | 0.1 | F-1 | 1.0 | 0.1 | 100 | 1.0 |
| t-5 | S-1 | 94.45 | A-1 | 4.5 | B-1 | 0.05 | F-1 | 1.0 | 4.8 | 1.1 | 1.1 |
| t-6 | S-1 | 97.9 | A-1 | 1.1 | B-1 | 0.5 | F-1 | 0.5 | 1.1 | 45.5 | 0.5 |
| t-7 | S-1 | 86.5 | A-1 | 1.1 | B-1 | 0.5 | F-1 | 9.9 | 1.2 | 45.5 | 11.1 |
| t-8 | S-1 | 95.2 | A-1 | 1.2 | B-1 | 0.1 | f-1 | 3.5 | 1.3 | 6.3 | 3.7 |
| t-9 | S-1 | 96.5 | — | — | — | — | F-1 | 3.5 | — | — | 3.5 |

S-2: Polydimethylsiloxane with a viscosity of $10\times10^{-6}$ $m^2/S$ at 25° C.

F-1: Magnesium distearate

F-2: Mixed higher fatty acid magnesium salt of palmitic acid/stearic acid=40/60 (molar ratio)

PS-1: Polyorganosiloxane with remaining silanol groups, produced from tetramethylsilane/

In Table 19,

S-1, F-1: As stated for Table 18 f-1: Magnesium dicaprylate

Test class 2 (evaluation and measurement of treatment agents)

The dispersion stability, average particle sizes and zeta potentials of the treatment agents prepared in Test Class 1 were evaluated and measured as described below. The results are shown in Table 20.

Evaluation of dispersion stability

Evaluated as described for Example 1.

Evaluation of viscosity property

Evaluated as described for Example 3.

Measurement of average particle size

The average particle size was measured as described for Example

Measurement of zeta potential

The zeta potential was measured as described for Example 1.

Evaluation of fiber friction coefficient

The friction coefficient was evaluated as described for Example 1.

Evaluation of winding form

The winding form was evaluated as described for Example 1.

Evaluation of reelability

The reelability was evaluated as described for Example 1. The results are shown in Table 21.

Evaluation of scum

TABLE 20

| Test No. | Treat-ment | Dispersion stability 1 week later | Dispersion stability 1 month later | Viscosity property | Average particle size Immediately after preparation (μm) | Average particle size 1 month later (μm) | Zeta potential (mV) |
|---|---|---|---|---|---|---|---|
| 1 | T-1 | AA | AA | A | 0.14 | 0.14 | −53 |
| 2 | T-2 | AA | AA | A | 0.16 | 0.16 | −74 |
| 3 | T-3 | AA | AA | A | 0.17 | 0.17 | −72 |
| 4 | T-4 | AA | AA | A | 0.19 | 0.19 | −80 |
| 5 | T-5 | A | A | A | 0.22 | 0.23 | −36 |
| 6 | T-6 | A | A | A | 0.21 | 0.22 | −41 |
| 7 | T-7 | AA | AA | A | 0.17 | 0.17 | −57 |
| 8 | T-8 | AA | AA | A | 0.18 | 0.19 | −70 |
| 9 | t-1 | A | B | A | 0.33 | 0.48 | −18 |
| 10 | t-2 | AA | AA | A | 0.19 | 0.19 | −69 |
| 11 | t-3 | AA | AA | E | 0.18 | 0.16 | −64 |
| 12 | t-4 | B | C | A | 0.24 | 0.32 | −7 |
| 13 | t-5 | AA | AA | C | 0.15 | 0.15 | −70 |
| 14 | t-6 | AA | AA | A | 0.16 | 0.16 | −49 |
| 15 | t-7 | A | A | C | 0.23 | 0.23 | −45 |
| 16 | t-8 | AA | AA | A | 0.21 | 0.21 | −70 |
| 17 | t-9 | C | C | A | 0.67 | 0.81 | 0 |

Test class 3 (Application of treatment agents to elastic polyurethane fibers, and evaluation)

Production of elastic polyurethane fibers and method for applying treatment agents Elastic polyurethane fibers were produced as described for Example 2, and treatment agents were applied.

Evaluation and measurement

Evaluated as described for Example 1. The results are shown in Table 21.

Evaluation of electricity control

Evaluated as described for Example 1. The results are shown in Table 21.

TABLE 21

| Example | Treat-ment | Deposited amount (%) | Fiber friction coefficient | Winding form | Reelabi-lity (%) | Evaluation of warping: Scum | Evaluation of warping: Elect-ricity control (kV) |
|---|---|---|---|---|---|---|---|
| Example 1 | T-1 | 6.5 | 0.29 | A | AA | AA | A |
| 2 | T-2 | 3.5 | 0.26 | A | AA | AA | A |
| 3 | T-3 | 5.0 | 0.28 | A | AA | A | A |
| 4 | T-4 | 5.0 | 0.27 | A | AA | A | A |
| 5 | T-5 | 5.0 | 0.29 | A | A | A | A |
| 6 | T-6 | 5.0 | 0.30 | A | A | A | A |
| 7 | T-7 | 5.0 | 0.32 | A | AA | AA | AA |
| 8 | T-8 | 5.0 | 0.33 | A | AA | AA | AA |
| Comparative Example 1 | t-1 | 5.0 | 0.26 | A | C | C | C |
| 2 | t-2 | 5.0 | 0.20 | C | C | C | C |
| 3 | t-3 | 5.0 | 0.18 | C | A | C | C |
| 4 | t-4 | 5.0 | 0.26 | A | C | C | B |
| 5 | t-5 | 5.0 | 0.17 | C | A | A | B |

TABLE 21-continued

| Example | Treatment | Deposited amount (%) | Fiber friction coefficient | Winding form | Reelability (%) | Evaluation of warping: Scum | Evaluation of warping: Electricity control (kV) |
|---|---|---|---|---|---|---|---|
| 6 | t-6 | 5.0 | 0.25 | A | C | A | A |
| 7 | t-7 | 5.0 | 0.23 | A | C | A | A |
| 8 | t-8 | 5.0 | 0.17 | C | A | C | C |
| 9 | t-9 | 5.0 | 0.27 | A | C | C | C |

INDUSTRIAL APPLICABILITY

The treatment agent for elastic polyurethane fibers according to the present invention can make elastic polyurethane fibers excellent in winding form and reelability, and can decrease the deposition and accumulation of scum on guides during processing, to allow stable operation in the production of elastic polyurethane fibers.

We claim:

1. A treatment agent for elastic polyurethane fibers comprising a dispersion in which a higher fatty acid magnesium salt represented by the Formula I is colloidally dispersed in a silicone mixture comprising a silicone oil with a viscosity of $5\times10^{-6}$ to $50\times10^{-6}$ $m^2/s$ at 25° C. as a dispersion medium and a dispersant comprising an amino modified silicone, represented by Formula II, at a ratio by weight of said dispersion medium to said dispersant of 100/0.5 to 100/4.5, wherein the amount of said higher fatty acid magnesium salt is 1 to 10 parts by weight per 100 parts by weight of said silicone oil;

wherein Formula I is:

Formula I

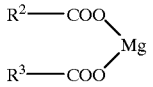

wherein $R^2$ and $R^3$ each represent an alkyl group with 11 to 21 carbon atoms;

wherein Formula II is:

Formula II

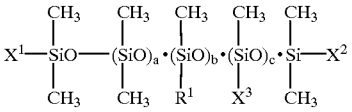

wherein $X^1$ and $X^2$ represent a methyl group or amino modified group represented by $—R^4(NH—R^5)d—NH_2$; at least one of them is the amino modified group, wherein $X^3$ represents an amino modified group represented by $—R^4(NH—R^5)d—NH_2$;

$R^1$ represents an alkyl group with 2 to 5 carbon atoms or a phenyl group;

$R^4$ and $R^5$ each represent an alkylene group with 2 to 5 carbon atoms;

a represents an integer of 25 to 400;

b represents an integer of 0 to 200, subject to the limitation that $25 \leqq a+b \leqq 400$, c represents an integer of 1 to 5; and d represents 0 or 1.

2. The treatment agent according to claim 1, wherein in the formula II representing an amino modified silicone; a is 100 to 200, and is 0.

3. The treatment agent according to claim 1, wherein the ratio by weight of the silicone oil to the amino modified silicone is 100/1.6 to 100/0.5, and the amount of the higher fatty acid magnesium salt is 2 to 8 parts by weight per 100 parts by weight of the silicone oil.

4. A treatment agent for elastic polyurethane fibers comprising a dispersion in which a higher fatty acid magnesium salt represented by the following Formula I is colloidally dispersed in a silicone mixture comprising a silicone oil with a viscosity of $5\times10^{-6}$ to $50\times10^{-6}$ $m^2/s$ at 25° C. as a dispersion medium and a dispersant comprising a carboxyamide modified silicone represented by Formula III, at a ratio by weight of said dispersion medium/said dispersant of 100/0.5 to 100/4.5, wherein the amount of said higher fatty acid magnesium salt is 1 to 10 parts by weight per 100 parts by weight of said silicone oil;

wherein Formula I is:

Formula I

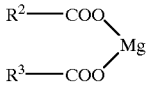

wherein $R^2$ and $R^3$ each represent an alkyl group with 11 to 21 carbon atoms; and wherein Formula III is:

Formula III

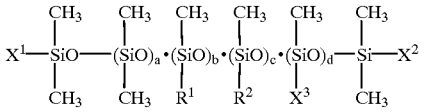

wherein $X^1$, $X^2$, and $X^3$ represent a methyl group or carboxyamide modified group represented by the formula IV; wherein at least one of them is said carboxyamide modified group, wherein $R^1$ represents an alkyl group with 2 to 5 carbon atoms or a phenyl group;

$R^2$ represents $—R^5—(NH—R^6—)f—NH_2$;

$R^5$ and $R^6$ represent an alkylene group having 2 to 5 carbon atoms, a is an integer of 25 to 400, b is an integer of 0 to 200, c is an integer of 0 to 5, subject to the limitation $25 \leqq a+b+c \leqq 600$ d represents an integer of 0 to 10 f is 0 or 1; and wherein Formula IV is:

$$—R^7—(NH—R^8—)e—NHCO—R^9—COOH \quad \text{Formula IV}$$

wherein $R^7$ and $R^8$ represent an alkylene group having 2 to 5 carbon atoms, $R^9$ represents an alkylene group having 2 to 20 carbon atoms, an alkenylene group with 2 to 20 carbon atoms, an alkenylethylene group having an alkenyl group having 2 to 20 carbon atoms or a phenylene group, and e is 0 or 1.

5. The treatment agent according to claim 4, wherein in the formula III representing a carboxyamide modified silicone, $X^3$ denotes a carboxyamide modified group, and d denotes 1 to 5.

6. The treatment agent according to claim 4, wherein in the formula III representing a carboxyamide modified silicone, $X^1$ and $X^2$ denote a methyl group and a is 100 to 200; b is 0; and c is 0 to 2.

7. The treatment agent for elastic polyurethane fibers according to claim 4, wherein the ratio by weight of the silicone oil to the carboxyamide modified silicone is 100/0.5 to 100/1.6, and the amount of the higher fatty acid magnesium salt is 2 to 8 parts by weight per 100 parts by weight of the silicone oil.

8. A treatment agent for elastic polyurethane fibers comprising a dispersion in which a higher fatty acid magnesium salt represented by the following Formula I is colloidally dispersed in a silicone mixture comprising a silicone oil with a viscosity of $5\times10^{-6}$ to $50\times10^{-6}$ $m^2/s$ at 25° C. as a dispersion medium and a dispersant comprising an amino modified silicone, represented by Formula II, and a carboxy modified silicone represented by the following Formula V wherein the ratio of said amino modified silicone to said carboxy modified silicone of 100/100 to 100/2, wherein the ratio by weight of said dispersion medium to said dispersant is 100/0.5 to 100/4.5, wherein the amount of said higher fatty acid magnesium salt is 1 to 10 parts by weight per 100 parts by weight of said silicone oil;

wherein Formula I is:

Formula I

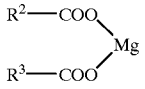

wherein $R^2$ and $R^3$ represent an alkyl group with 11 to 21 carbon atoms; and wherein Formula II is:

Formula II

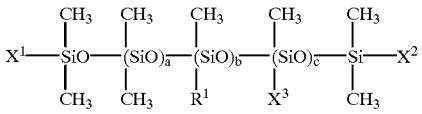

wherein $X^1$, $X^2$, and $X^3$ each represent a methyl group or amino modified group represented by $—R^4(NH—R^5)d—NH_2$; at least one of them is the amino modified group;

wherein $R^1$ represents an alkyl group with 2 to 5 carbon atoms or a phenyl group;

$R^4$ and $R^5$ represents an alkylene group with 2 to 5 carbon atoms;

a represents an integer of 25 to 400;

b is an integer of 0 to 200, subject to the limitation that $25 \leqq a+b \leqq 400$;

c represents an integer of 0 to 10; and d represents 0 or 1; and wherein Formula V is:

Formula V

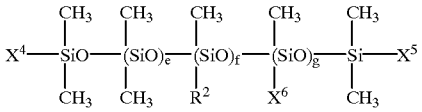

wherein $X^4$, $X^5$, and $X^6$ each represent a methyl group or carboxy modified group represented by —R7—COOH; at least one of them is a carboxy modified group, $R^2$ represents an alkyl group having 2 to 5 carbon atoms or phenyl groups;

$R^7$ is an alkylene group with 2 to 5 carbon atoms;

e is an integer of 25 to 800;

f is an integer of 0 to 200, subject to the limitation $25 \leqq e+f<800$; and g is an integer of 0 to 20.

9. The treatment agent for elastic polyurethane fibers according to claim 8, wherein in the formula II $X^3$ denotes an amino modified group, and c is 1 to 5.

10. The treatment agent according to claim 8, wherein in the formula II $X^1$ and $X^2$ each denote a methyl group; a is 100 to 200; and b is 0.

11. The treatment agent for elastic polyurethane fibers according to claim 8, wherein in the formula V, e is 100 to 400, and f is 0.

12. The treatment agent for elastic polyurethane fibers according to claim 8, wherein the ratio by weight of the silicone oil to the total of the amino modified silicone and the carboxy modified silicone is 100/1.6 to 100/05, and the amount of the higher fatty acid magnesium salt is 2 to 8 parts by weight per 100 parts by weight of said silicone oil.

13. The treatment agent according to any one of claims 1, 4, or 8, wherein the average particle size of the higher fatty acid magnesium salt colloidally dispersed is 0.1 to 0.5 $\mu$m.

14. The treatment agent according to any one of claims 1, 4, or 8, wherein the dispersion medium has a zeta potential of −30 to −100 mV at 25° C.

15. Elastic polyurethane fibers comprising the treatment agent for elastic polyurethane fibers defined in claim 13 deposited at 1 to 10 wt % by a neat oiling method without dilution.

16. Elastic polyurethane fibers comprising the treatment agent for elastic polyurethane fibers defined in claim 14 deposited at 1 to 10 wt % by a neat oiling method without dilution.

17. The treatment agent according to any one of claim 1, 4 or 8, wherein the dispersion further contains 0.5 to 5 parts by weight of a polyorganosiloxane per 100 parts by weight of the silicone oil;

wherein said polyorganosiloxane is a polycondensation product of the reaction of a silanol compound (A) capable of forming a silicic anhydride component represented by Formula VI and a silanol compound (B) capable of forming a monovalent organosiloxane component represented by Formula VII at a molar ratio of said compound (A) to compound (B) of k/(8/5×(k+1) to k/(2/5×(k+1)), where k is an integer of 1 or more;

$(SiO_{4/2})$ Formula VI $(R^8R^9R^{10}SiO_{1/2})$ Formula VII wherein $R^8$, $R^9$, and $R^{10}$ represent, independently, an alkyl group having 1 to 3 carbon atoms or a phenyl group;

wherein said organosiloxane component VII is a silyl terminal group; and said polyorganosiloxane comprises residual silanol.

18. Elastic polyurethane fibers comprising the treatment agent for elastic polyurethane fibers defined in claim 17 deposited at 1 to 10 wt % by a neat oiling method without dilution.

* * * * *